US005928850A

United States Patent [19]

Murai et al.

[11] Patent Number: 5,928,850

[45] Date of Patent: Jul. 27, 1999

[54] SILVER HALIDE PHOTOGRAPHIC LIGHT-SENSITIVE MATERIAL

[75] Inventors: Kazuhiro Murai, Odawara; Shigeo Tanaka, Hino; Kunimasa Hiyama, Odawara, all of Japan

[73] Assignee: Konica Corporation, Japan

[21] Appl. No.: 08/801,151

[22] Filed: Feb. 18, 1997

[30] Foreign Application Priority Data

Feb. 19, 1996 [JP] Japan ..... 8-030680

[51] Int. Cl.[6] ..... G03C 7/26; G03C 7/32; G03C 1/08

[52] U.S. Cl. ..... 430/546; 430/557; 430/551; 430/607; 430/609; 430/613; 430/614; 430/631; 430/632; 430/633; 430/634; 430/635; 430/636; 430/637; 430/638; 430/627

[58] Field of Search ..... 430/546, 557, 430/551, 607, 609, 613, 614, 631, 632.8, 627

[56] References Cited

U.S. PATENT DOCUMENTS 3,619,195 11/1971 VanCampen ..... 430/546
5,006,453 4/1991 Takahashi et al. ..... 430/546
5,071,738 12/1991 Mizukura et al. ..... 430/546

*Primary Examiner*—Geraldine Letscher
*Attorney, Agent, or Firm*—Jordan B. Bierman; Bierman, Muerlian and Lucas

[57] ABSTRACT

A silver halide photographic light-sensitive material is disclosed. The light-sensitive material comprises a dispersion material which is obtained by emulsifying a mixture of a yellow coupler represented by the formula and a polymer compound that is insoluble in water and soluble in an organic solvent.

12 Claims, No Drawings

SILVER HALIDE PHOTOGRAPHIC LIGHT-SENSITIVE MATERIAL

FIELD OF THE INVENTION

The present invention relates to a silver halide photographic light-sensitive material, and more specifically to a silver halide photographic light-sensitive material suitable for rapid processing and also suitable for a printing material for direct appreciation wherein stable high image quality can be obtained even on processing fluctuations.

A silver halide photographic light-sensitive material, specifically a silver halide color photographic light-sensitive material is used quite frequently due to its excellency in terms of high speed and gradation properties.

Recently, in the field of photography, from viewpoint of improvement in terms of environment friendliness and production efficiency, demand for low replenishment and rapid processing has gradually been proliferated. A silver halide photographic light-sensitive material which can maintain stable high image performance even during rapid processing.

Achievement of rapid processing has been approached from two issues, i.e., processing solution and light-sensitive material. In the field of color developing, enhancement of pH, increase of temperature and increase of the density of color developing agents have been have been studied.

However, in the case of rapid processing means employing the above-mentioned processing solution, unnecessary coloring of unexposed portions, i.e., increase of fogging becomes problematic since the processing solution further becomes highly active. Another problem is that, the shorter the processing time is, the more the pH and the temperature of the processing solution and the amount of color developing agent tend to be influenced by their fluctuations. Accordingly, due to the distribution of the daily processing amount or differences in the replenishment system of the developing solution, changes of image quality properties such as the level of the maximum coloring density and gradation fluctuation is noticeably influenced.

In order to reduce the level change of the maximum coloring density, technologies to increase the amount of a yellow coupler or silver halide may be used. However, the degree of improvement is so small that an increase of fogging becomes further deteriorated. In addition, an increase of aforesaid amount results in adverse manufacturing efficiency and environment friendliness. Therefore, it is important to obtain stable image quality properties at minimal coating amount.

Due to the above-mentioned consideration, various technologies were developer which may maintain stable high image quality performance under processing times which are considerably shorter than before. As a result, the present inventors discovered that the above-mentioned objects can be attained by the use of a dispersant wherein a coupler having a specific structure was emulsified and dispersed under specific conditions so that the present invention was attained.

Japanese Patent Publication Open to Public Inspection (Japanese Patent O.P.I. Publication) No. 130596/1994 discloses a silver halide photographic light-sensitive material which contains a specific yellow coupler which is used as a dispersant wherein a mixed solvent in which a silver halide emulsion comprising silver chloride of 95 mol % or more coexists with a water-insoluble and organic solvent-soluble polymer compound and which contains an UV absorber as a dispersant dispersed in the same manner can obtain a high quality image excellent in durability. Aforesaid invention illustrates some compounds represented by the above-mentioned Formula I as preferable examples of a yellow coupler. However, aforesaid invention does not describe stabilization of photographic performance under processing fluctuations. In addition, in aforesaid invention, only some compounds represented by Formula I are illustrated. Therefore, compounds out of the requirements of the present invention could not obtain effects of the present invention.

Japanese Patent O.P.I. Publication No. 26133/1972 discloses an image forming method which processes a silver halide photographic light-sensitive material in the presence of acetamido substituted with a diacylamino group and an aliphatic acyl group at an α position and a color developing agent, in which compounds having split-off groups and anti-diffusion groups represented by Formula are disclosed. In addition, Japanese Patent O.P.I. Publication No. 30126/1981 discloses a light-sensitive material which contains a yellow- or magenta-coloring couplers each having an aryloxy carbonyl aryl group, in which compounds represented by Formula I are illustrated. However, effects which can be obtained for the first time by combining polymer compounds are not described at all.

SUMMARY OF THE INVENTION

An object of the present invention is to provide a silver halide photographic light-sensitive material wherein high image properties having high coloring properties and preferable gradation are maintained stably and increase of fogging due to highly activate chemical of processing can be sufficiently minimized without increasing the amount of a yellow coupler (hereinafter, referred also as "yellow coupler") even if the conditions of the developing solution used vary in many ways in a processing system in which rapid processing has been realized than before.

The silver halide photographic light-sensitive material of the present invention comprises a support and a silver halide emulsion layer containing a dispersion material which is obtained by emulsifying a mixture of a yellow coupler represented by Formula I and a polymer compound that is insoluble in water and soluble in an organic solvent.

Formula I

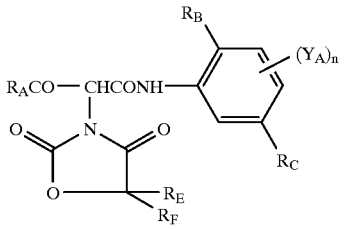

wherein $R_A$ represents an alkyl group; $R_B$ represents a halogen atom or an alkoxy group; $R_C$ represents —$COOR_{D1}$, —$COOR_{D2}$ $COOR_{D1}$—$NHCOR_{D2}SO_2R_{D1}$, —$N(R_{D3})SO_2R_{D1}$, —$NHCOR_{D2}SO_2R_{D1}$, —$N(R_{D3})SO_2R_{D1}$ or —$SO_2N(R_{D3})R_{D1}$; $R_{D1}$ represents a monovalent organic group; $R_{D2}$ represents an alkylene group; $R_{D3}$ represents an alkyl group, an aralkyl group or a hydrogen atom; $Y_A$ represents a monovalent organic group; n represents 0 or 1; and $R_E$ and $R_F$ independently represent a hydrogen atom or an alkyl group.

In the formula, n is preferably 0.

The mixture of the yellow coupler and the polymer to be emulsified may further contains an organic solvent having high boiling point.

In the silver halide photographic light-sensitive material the amount of the yellow coupler is $0.50\times10^{-3}$–$1.10\times10^{-3}$ mol/m$^2$.

The silver halide photographic light-sensitive material preferably comprises a compound represented by formula 1.

Formula 1

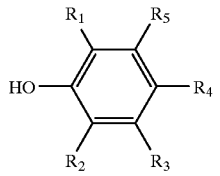

wherein $R_1$ is a tertiary alkyl group; $R_2$ is a primary or a secondary alkyl group; $R_3$, $R_4$ and $R_5$ are each an alkyl group, an alkoxycarbonyl group, a phenoxycarbonyl group, an alkoxy group, a phenoxy group or a phenylthio group, the groups represented by $R_1$, $R_3$, $R_4$ or $R_5$ each may have a substituent and the group represented by $R_2$ may has a substituent other than a phenyl group.

The compound is preferably added to the mixture for preparing the dispersion material.

In the silver halide photographic light-sensitive material an anti-stain agent is preferably contained in a layer containing the yellow coupler. The anti-stain agent is contained in the amount of 1–5 mol % of the yellow coupler. Examples of the anti-stain agent are hydroquinone derivatives including 2,5-di-t-octyl hydroquinone, 2,5-di-s-dodecyl hydroquinone, 2,5-di-s-tetradecyl hydroquinone, 2-s-tetradecyl-5-s-dodecyl hydroquinone and 2-5-di-(4-hexyloxycarbonyl-t-hexyl) hydroquinone, gallic acid derivatives, 2,4-disulfonamide phenol derivatives and hydrazine derivatives.

In the silver halide photographic light-sensitive material a compound represented by Formula B is preferably contained in a layer containing the yellow coupler.

Formula B

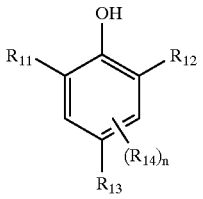

wherein $R_{11}$, $R_{12}$ and $R_{13}$ independently represent a hydrogen atom or a straight-chained or branch-chained unsubstituted alkyl group; $R_{14}$ represents an alkyl group or a halogen atom, provided that $R_{11}$, $R_{12}$ and $R_{13}$ are not concurrently hydrogen atoms; n represents 0, 1 or 2; and when n is 2, two $R_{14}$ may be the same or different.

In the silver halide photographic light-sensitive material a phenol compound having a branched alkyl group only at a para-position is preferably contained in a yellow coupler-containing layer.

DETAILED DISCLOSURE OF THE INVENTION

The silver halide photographic light-sensitive material of the invention contains a yellow coupler represented by Formula I. The yellow coupler represented by Formula I will be explained.

As an alkyl group represented by RA, a straight-chained, branch-chained or cyclic alkyl group, including a methyl group, an ethyl group, an i-propyl group, a t-butyl group, a dodecyl group, a one-hexylnonyl group, a cyclopropyl group, a cyclohexyl group and an adamantyl group are cited.

The above-mentioned alkyl group may further be substituted. As a substituent, for example, a halogen atom (a chlorine atom and a bromine atom), an aryl group (for example, a phenyl group, or a p-t-octylphenyl group), an alkoxyl group (for example, a methoxy group), an aryloxy group (for example, a 2,4-di-t-pentylphenoxy group), a sulfonyl group (for example, a methanesulfonyl group), an acyl group (for example, an acetyl group and a benzoyl group), a sulfonylamino group (for example, a dodecanesulfonyl amino group) and a hydroxyl group are cited.

As an $R_A$, a branched alkyl group is preferable. Specifically, a t-butyl group is preferable.

As an alkoxy group represented by $R_B$, a straight-chained and branched alkoxy group including a methoxy group, an ethoxy group, a 1-methylethyloxy group, a t-butyloxy group, a dodecyloxy group and a 1-hexylnonyloxy group are cited. Of these, a methoxy group is preferable.

As a halogen atom represented by $R_B$, for example a chlorine atom, a bromine atom and a fluorine atom are cited. Of these, a chlorine atom is preferable.

In $COOR_{D1}$, $—COOR_{D2}COOR_{D1}$, $—NHCOR_{D2}SO_2R_{D1}$, $—N(R_{D3})SO_2R_{D1}$ or $—SO_2N(R_{D3})R_{D1}$ represented by $R_C$, as a monovalent organic group represented by $R_{D1}$, a group having functions as an anti-diffusion group is preferable. For example, a straight-chained or branch alkyl group having 10 or more carbons (for example, a dodecyl group and an octadecyl group) or an aryl group (2,4-dipentylphenyl group) are preferable. A straight-chained or branch alkyl group having 14 or more carbons is more preferable. As an alkylene group represented by $R_{D2}$, for example, a propylene group and a trimethylene group are preferable. As an alkyl group represented by $R_{D3}$, a straight-chained or branched alkyl group including a methyl group, an ethyl group and an i-propyl group are preferable. As an aralkyl group, for example, a benzyl group are cited.

As $R_C$, the $—COOR_{D1}$ group is preferable.

As an alkyl group represented by $R_E$ and $R_F$, a straight-chained and branched alkyl group having 1–10 carbons including a methyl group, an ethyl group, an i-propyl group, a butyl group and a hexyl group are cited. Specifically, the methyl group is preferable.

As a monovalent organic group represented by $Y_A$, for example, an alkyl group (including an ethyl group, an i-propyl group and a t-butyl group), an alkoxy group (for example, a methoxy group), an aryloxy group (for example, a phenyloxy group), an acyloxy group (for example, a methylcarbonyloxy group and a benzoyloxy group), an acylamino group (for example, an acetoamide group and a phenylcarbonylamino group), a carbamoyl group (for example, an N-methylcarbamoyl group and an N-phenylcarbamoyl group), an alkylsulfonylamino group (for example, an ethylsulfonylamino group), an arylsulfonylamino group (for example, a phenylsulfonyl amino group), a sulfamoyl group (for example, an N-propyl sulfamoyl group and an N-phenylsulfamoyl group) and an imido group (for example, a succinic acid imido group and a glutaric imido group) are cited.

The yellow coupler represented by Formula I can be synthesized by any conventional methods. By combining compounds respectively represented by Formula I or which do not damage the effects of the present invention, a coupler represented by Formula I and another coupler may be combined to be used.

The amount of yellow couplers coated in the silver halide photographic light-sensitive material is preferably $0.50\times10^{-3}$–$1.10\times10^{-3}$ mol/m$^2$ and more preferably $0.60\times10^{-3}$–$1.00\times10^{-3}$ mol/m$^2$. Most preferably $0.65\times10^{-3}$–$1.0\times10^{-3}$, and further $0.75\times10^{-3}$–$0.95\times10^{-3}$ mol/m$^2$ is suitable. The amount of couplers referred here is defined to be the total amount of the yellow couplers, not limited to the amount of compound represented by Formula (I).

Practical examples of yellow couplers represented by Formula (I) will be exemplified.

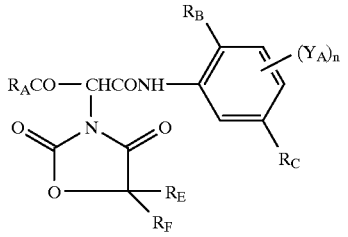

| | $R_A$ | $R_B$ | $R_C$ | n | $R_E$ | $R_F$ |
|---|---|---|---|---|---|---|
| I-1 | (t)$C_4H_9$— | —$OCH_3$ | —$COOC_{12}H_{25}$ | 0 | —$CH_3$ | —$CH_3$ |
| I-2 | 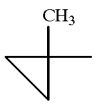 | —$OCH_3$ | —$COOC_{16}H_{33}$ | 0 | —$CH_3$ | —$CH_3$ |
| I-3 | (t)$C_5H_{11}$— | —$OCH_3$ | —$COOC_{12}H_{25}$ | 0 | —$CH_3$ | —$CH_3$ |
| I-4 | (t)$C_4H_9$— | —$OCH_3$ | —$COOC_{14}H_{19}$ | 0 | —$CH_3$ | —$CH_3$ |
| I-5 | (t)$C_4H_9$— | —$OCH_3$ | —$COOC_{16}H_{33}$ | 0 | —$CH_3$ | —$CH_3$ |
| I-6 | (t)$C_4H_9$ | —$OCH_3$ | —$COOCH_2CH(C_8H_{17})_2$ | 0 | —$CH_3$ | —$CH_3$ |
| I-7 | (t)$C_4H_9$— | —$OCH_3$ | —$COOC_{16}H_{33}$ | 0 | —$C_2H_5$ | —$C_2H_5$ |
| I-8 | (t)$C_4H_9$— | —$OCH_3$ | —$COOC_{16}H_{33}$ | 0 | —H | —$CH_3$ |
| I-9 | (t)$C_4H_9$— | —$OCH_3$ | —$COOC_{16}H_{33}$ | 0 | —$C_4H_9$ | —$C_4H_9$ |
| I-10 | (t)$C_4H_9$— | —$OC_2H_5$ | —$COOC_{16}H_{33}$ | 1 | —$CH_3$ | —$CH_3$ |
| | | | $Y_A$: —$CH_3$ Namely 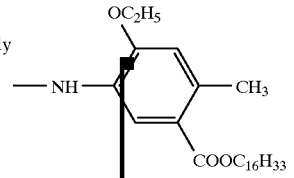 | | | |
| I-11 | (t)$C_4H_9$— | —Cl | —$COOC_{12}H_{25}$ | 0 | —$CH_3$ | —$CH_3$ |
| I-12 | 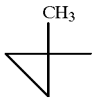 | —Cl | —$COOC_{16}H_{33}$ | 0 | —$CH_3$ | —$CH_3$ |
| I-13 | (t)$C_5H_{11}$— | —Cl | —$COOC_{12}H_{25}$ | 0 | —$CH_3$ | —$CH_3$ |
| I-14 | (t)$C_4H_9$— | —Cl | —$COOC_{14}H_{29}$ | 0 | —$CH_3$ | —$CH_3$ |
| I-15 | (t)$C_4H_9$— | —Cl | —$COOC_{16}H_{33}$ | 0 | —$CH_3$ | —$CH_3$ |
| I-16 | (t)$C_4H_9$— | —Cl | —$COOCH_2CH(C_8H_{17})_2$ | 0 | —$CH_3$ | —$CH_3$ |
| I-17 | (t)$C_4H_9$— | —Cl | —$COOC_{16}H_{33}$ | 0 | —$C_2H_5$ | —$C_2H_5$ |
| I-18 | (t)$C_4H_9$— | —Cl | —$COOC_{16}H_{33}$ | 0 | —H | —$CH_3$ |
| I-19 | (t)$C_4H_9$— | —Cl | —$COOC_{16}H_{33}$ | 0 | —$C_4H_9$ | —$C_4H_9$ |
| I-20 | (t)$C_4H_9$— | —Br | | 1 | —$CH_3$ | —$CH_3$ |

-continued

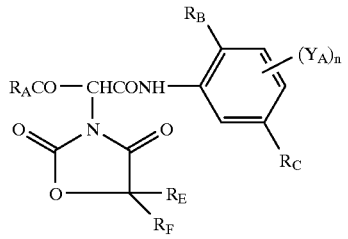

| $R_A$ | | $R_B$ | $R_C$ | n | $R_E$ | $R_F$ |
|---|---|---|---|---|---|---|
| | | | $Y_A$: —$CH_3$ | | | |
| | | | Namely 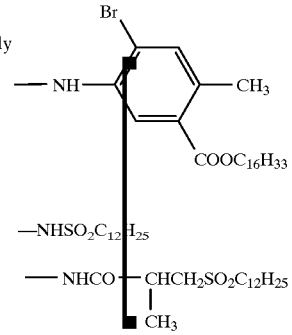 | | | |
| I-21 | (t)$C_4H_9$— | —Cl | —$NHSO_2C_{12}H_{25}$ | 0 | —$CH_3$ | —$CH_3$ |
| I-22 | (t)$C_4H_9$— | —Cl | —NHCO—$CHCH_2SO_2C_{12}H_{25}$ (—$CH_3$) | 0 | —$CH_3$ | —$CH_3$ |
| I-23 | (t)$C_4H_9$— | —$OC_{18}H_{37}$ | 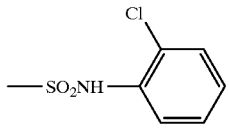 | 0 | —$CH_3$ | —$CH_3$ |

The yellow coupler is emulsified together with at least one kind of polymer compound insoluble in water and soluble in organic solvent. An organic solvent having high boiling point may be used in addition to the polymer.

The water-insoluble and organic-solvent-soluble polymer compound will be explained.

As the water-insoluble and organic-solvent-soluble polymer usable for the above-mentioned objects, 1. a vinyl polymer and copolymer
2. a condensed polymer of a multi-valent alcohol and a polybasic acid
3. a polyester obtained by a ring opening polymerization method
4. other polymers Hereinafter, items (1) through (4) above will be explained.

(1) Vinyl Polymer and Copolymer

As a monomer forming a vinyl polymer and copolymer, acrylic acid esters such as methylmethacrylate, butylacrylate, isopropyl acrylate, butylacrylate, amylacrylate, hexyl acrylate, 2-ethylhexyl acrylate, t-octyl acrylate, 2-chloroethyl acrylate, cyanoethyl acrylate, 2-acetoxyethylacrylate, dimethylaminoethyl acrylate, methoxybenzyl acrylate and phenylacrylate; methacrylic acid esters such as methyl methacrylate, ethyl methacrylate, propyl methacrylate, butyl methacrylate, isopropyl methacrylate, amyl methacrylate, cyclohexyl methacrylate, benzyl methacrylate, octyl methacrylate, sulfopropyl methacrylate, phenyl methacrylate, crezyl methacrylate and 2-hydroxyethylmethacrylate; vinyl esters such as vinyl acetate, vinyl propyonate, vinyl butylate, vinyl isobutylate, vinyl chloroacetate, vinyl methoxyacetate, vinylphenyl acetate, vinyl benzoic acid and vinyl salicylic acid; acrylic amides such as acrylic acid, ethylacrylic amide, propylacrylic amide, butylacrylic amide, t-butylacrylic amide, cyclohexylacrylic amide, benzylacrylic amide, hydroxymethylacrylic amide, methoxyethylacrylic amide, dimethylaminoethylacrylic amide, phenylacrylic amide, dimethylacrylic amide and N-(2-hydroxy-5-ethylsulfonylphenyl) acrylic amide; methacrylic amides such as methacrylic amide, methylmethacrylic amide, ethylmethacrylic amide, propylmethacrylic amide, butylmethacrylic amide, t-butylmethacrylic amide, cyclohexyl-methacrylic amide, benzylmethacrylic amide, hydroxymethyl-methacrylic amide, methoxyethylmethacrylic amide, dimethylmethacrylic amide, dimethylaminoethyl, phenolmethacrylic amide and N-(3-hydroxyphenyl)methacrylic amide; olefins such as dicycloropentadiene, ethylene, propylene, 1-butene, 1-pentene, butadiene, isoprene, chloroprene, vinyl chloride and vinylidene chloride; and styrenes such as styrene, methylstyrene, trimethylstyrene, ethylstylene, chloromethylstylene, methoxystylene, chlorostylene, dichlorostylene and benzoic acid stylene are cited. In addition, crotonic acid ester such as butyl crotonic acid, diester itaconic acid such as diethyl itaconic acid, diester maleic acid such as dimethyl maleic acid, diester phmalic acid such as dimethyl phmalic acid, an allyl compound such as allyl acetic acid, vinyl ethers such as methylvinyl ether and methoxyethylvinyl ether, vinylketones such as methylvinyl ketone, vinyl heterocyclic compounds such as vinyl pyridine and N-vinyl oxazolidone, glycidyl esters such as glycidyl acrylate and unsaturated nitriles such as acrylonitrile are cited.

To obtain the polymer compound, a homopolymer of the above-mentioned monomer may be used. In addition, as necessary, a copolymer composed of two or more kind of monomers. In addition, aforesaid polymer compounds may contain a monomer having an acid residue in such a manner that aforesaid polymer compound does not become water-solubilizing as described below. Namely, 20% or less is preferable and not containing is more preferable.

As a monomer having an acid residue, acrylic acid, methacrylic acid, itaconic acid, maleic acid, itaconic acid monoalkyl, maleic acid monoalkyl, citraconic acid, stylene sulfonic acid, vinylbenzylsulfonic acid, acryloyloxy alkyl sulfonic acid, methacryloyloxy alkyl sulfonic acid, acrylamide alkylsulfonic acid, methacrylamide alkyl sulfonic acid, acryloyl oxy alkyl phosphate and methacryloyl oxy phosphate are cited. The above-mentioned acids may form a salt with an alkaline metal (for example, Na and K) or an ammonium ion.

As a monomer forming a polymer used in the present invention, acrylate-type, methacrylate-type, acrylic amide-type and methacrylate-type are preferable.

A polymer formed from the above-mentioned monomer employs a solution polymerization method, a block polymerization method, a suspension polymerization method and a latex polymerization method. As a starter used for aforesaid polymerization, a water-soluble polymerization starters and lipophilic polymerization starters are used. As the water-soluble polymerization starters, for example, persulfates such as potassium persulfate, ammonium persulfate and sodium persulfate, water-soluble azo compounds such as 2,2'-azobis(2-amidinopropane) sulfate and hydrogen perhydride may be used. As a lipophilic polymerization starter, for example, azobisisobutylonitrile, 2,2'-azobis-2,4-dimethylvaleronitrile), 1,1'-azobis-(cyclohexanone-1-carbonitrile), 2,2'-azobisiso dimethyl lactic acid and 2,2'-azobisiso diethyl lactic acid, benzoyl peroxide, laurylperoxide, diisopropylperoxydicarbonate and di-t-butylperoxide are cited.

(2) Polyester resin obtained through condensation of polyhydric alcohol and polybasic acid As a polyhydric alcohol, glycols having a structure of HO—$R_1$—OH (wherein $R_1$ represents a hydrocarbon having 2 to 12 carbons, specifically an apliphatic group hydrocarbon chain) or polyalkylene glycol are effective. As a polybasic acid, those having HOOC—$R_2$—COOH (wherein $R_2$ represents a mere bondage or a hydrocarbon chain having 1 to 12 carbons).

As practical examples of polyhydric alcohol, ethylene glycol, diethyleneglycol, 1,2-propylene glycol, 1,3-propylene glycol, trimethylol propane, 1,4-butandiol, isobutylenediol, 1,5-pentanediol, neopentylglycol, 1,6-hexanediol, 1,8-octanediol, 1,9-nonanediol, 1,10-decanediol, glycerin, diglycerin, triglycerin, 1-methyl glycerin, erythrite, mannitol and sorbitol are cited.

As practical examples of polybasic acid, oxalic acid, citric acid, glutaric acid, adipinic acid, pimelic acid, cork acid, azelaic acid, sebasic acid, decanedicarbonic acid, dodecane dicarbonic acid, phmalic acid, maleic acid, itaconic acid, citracone acid, phthalic acid, isophthalic acid, terephthalic acid, tetrachlorophthalic acid, mataconic acid, isohymeric acid, cyclopentadiene-maleic acid anhydride additive and rhodine-maleic acid anhydride additive are cited.

(3) Polyester obtained by the open-ring polymerization method

The above-mentioned polyesters can be obtained by β-propioractone, ε-caproractone and dimethylpropioractone.

(4) Other polymers

Novolac resins, polycarbonate resins obtained through condensation polymerization between glycol or divalent phenol and ester carbonic acid or phosgene, polyurethane resins through polyaddition between a polyhydric alcohol and multivalent isocyanate and polyamide resins obtained through multivalent amine and polybasic acid are cited.

The number average molecular weight of the polymer used in the present invention is not specifically limited. It is preferably 200,000 or less, more preferably 5,000–100,000, still more preferably 5,000–100,000, still yet more preferably 200,000 or less and the most preferably 5,000–12,000.

The ratio of the polymer of the present invention to the coupler (weight ratio) is preferably 1:20–20:1 and more preferably 1:10–10:1.

Practical examples of polymers used in the present invention will be exhibited as follows (the composition of copolymer is represented by weight ratio).

P-1: Poly(N-sec-butylacrylic amide)
P-2: Poly(N-t-butylacrylic amide) (specifically preferable)
P-3: Diacetoneacrylic amide-methyl methacrylate copolymer (25:75)
P-4: Polycyclohexylmethacrylate
P-5: N-t-butylacrylic amide-methyl methacrylate copolymer (60:40)
P-6: Poly(N,N-dimethylacrylic amide)
P-7: Poly(t-butylmethacrylate)
P-8: Polyvinylacetate
P-9: Polyvinyl acetate
P-10: Polymethylmethacrylate
P-11: Polyethylmethacrylate
P-12: Polyethylacrylate
P-13: Vinyl acetic acid-vinyl alcohol copolymer (90:10)
P-14: Polybutylacrylate
P-15: Polybutylmethacrylate
P-16: Polyisobutylmethacrylate
P-17: Polyisopropylmethacrylate
P-18: Polyoctylacrylate
P-19: Butylacrylate-acrylic amide copolymer (95:5)
P-20 Stearylmethacrylate-acrylic acid copolymer (90:10)
P-21: Methylmethacrylate-vinylchloride copolymer (70:30)
P-22: Methylmethacrylate-styrene copolymer (90:10)
P-23: Methylmethacrylate-ethylacrylate copolymer (50:50)
P-24: Butylmethacrylate-methylmethacrylate-styrene copolymer (50:20:30)
P-25: Vinylacetic acid-acrylic amide copolymer (65:35)
P-26: Vinylchloride-vinyl acetic acid copolymer (65:35)
P-27: Methylmethacrylate-acrylic nitrile copolymer (65:35)
P-28: Butylmethacrylate-pentylmethacrylate-N-vinyl-2-pyrrolidone copolymer (38:38:24)
P-29: Methylmethacrylate-butylmethacrylate-isobutylmethacrylate-acrylic acid copolymer (37:29:25:9)
P-30: Butylmethacrylate-acrylic acid copolymer (95:5)
P-31: Methylmethacrylate-acrylic acid copolymer (95:5)
P-32: Benzylmethacrylate-acrylic acid copolymer (93:7)
P-33: Butylmethacrylate-methylmethacrylate-benzylmethacrylate-acrylic acid copolymer (35:35:25:5)
P-34: Butylmethacrylate-methylmethacrylate-benzylmethacrylate copolymer (40:30:30)
P-35: Diacetoneacrylic amide-methylmethacrylate copolymer (50:50)

P-36: Methylvinylketone-isobutylmethacrylate copolymer (55:45)
P-37: Ethylmethacrylate-butylacrylate copolymer (70:30)
P-38: Diacetoneacrylic amide-butylacrylate copolymer (60:40)
P-39: Methylmethacrylate-styrenemethacrylate-diacetone acrylate copolymer (40:40:20)
P-40: Butylacrylate-styrenemethacrylate-diacetoneacrylic amide copolymer (70:20:10)
P-41: Stearylmethacrylate-methylmethacrylate-acrylic acid copolymer (50:40:10)
P-42: Methylmethacrylate-styrene-vinylsulfonic amide copolymer (70:20:10)
P-43: Methylmethacrylate-phenylvinylketone copolymer (70:30)
P-44: Butylmethacrylate-N-vinyl-2-pyrrolidone copolymer (90:10)
P-45: Butylmethacrylate-N-vinyl-2-pyrrolidone copolymer (90:10)
P-46: Polypentylacrylate
P-47: Cyclohexylmethacrylate-methylmethacrylate-propylmethacrylate copolymer (37:29:34)
P-48: Polypentylmethacrylate
P-49: Methylmethacrylate-butylmethacrylate copolymer (65:35)
P-50: Vinylacetate vinylpropionate copolymer (75:25)
P-51: Sodium butylmethacrylate-3-acrylic oxy butane-1-sulfonic acid copolymer (97:3)
P-52: Butylmethacrylate-methylmethacrylate-acrylic amide copolymer (35:35:30)
P-53: Butylmethacrylate-methylmethacrylate-vinyl chloride copolymer (37:36:27)
P-54: Butylmethacrylate-styrene copolymer (82:12)
P-55: t-butylmethacrylate-methylmethacrylate copolymer (70:30)
P-56: Poly(N-t-butylmethacrylic amide)
P-57: N-t-butylacrylic amide-methylphenylmethacrylate copolymer (60:40)
P-58: Methylmethacrylate-acrylic nitrile copolymer (70:30)
P-59: Methylmethacrylate-methylvinyl ketone copolymer (38:72)
P-60: Methylmethacrylate-hexylmethacrylate copolymer (70:30)
P-61: Methylmethacrylate-hexylmethacrylate copolymer (70:30)
P-62: Butylmethacrylate-acrylic acid copolymer (85:15)
P-63: Methylmethacrylate-acrylic acid copolymer (80:20)
P-64: Methylmethacrylate-acrylic acid copolymer (90:10)
P-65: Methylmethacrylate-acrylic acid copolymer (98:2)
P-66: Methylmethacrylate-N-vinyl-2-pyrrolidone copolymer (90:10)
P-67: Butylmethacrylate-vinylchloride copolymer (90:10)
P-68: Butylmethacrylate-styrene copolymer (70:30)
P-69: 1,4-butanediol-adipic acid polyester
P-70: Ethylene glycol-sebasic acid polyester
P-71: Polycaproractam
P-72: Polypropioractam
P-73: Polydimethylpropioractone
P-74: N-t-butylacrylic amide-dimethylaminoethylacrylic amide copolymer (85:15)
P-75: N-t-butylmethacrylicamide-vinylpyridine copolymer (95:5)
P-76: Diethylmaleic acid-butylacrylate copolymer (65:35)
P-77: N-t-butylacrylic amide-2-methoxyethylacrylate copolymer (55:45)
P-78: ω-methoxypolyethylene glycol methacrylate (mol number added n=6)-methylmethacrylate (40:60)
P-79: ω-methoxypolyethylene glycol acrylate (the number of mol added n=9) -N-t-butylacrylic amide (25:75)
P-80: Poly(2-methoxyethylacrylate)
P-81: Poly(2-methoxyethylmethacrylate)
P-82: Poly[2-(2-methoxyethoxy)ethylacrylate]
P-83: 2-(2-buthoxyethoxy)ethylacrylate-methylmethacrylate (58:42)
P-84: Poly(oxycarbonyloxy-1,4-phenyleneisobuthylidene-1,4-phenylene)
P-85: Poly(oxyethyleneoxycarbonyliminohexamethylene-iminocarbonyl)
P-86: N-[4-(4'-hydroxyphenylsulfonyl)phenyl]acrylic amide-butylacrylate copolymer (65:35)
P-87: N-(4-hydroxyphenyl)methacrylic amide-N-t-butyl acrylic amide copolymer (50:50)
P-88: [4-(4'-hydroxylphenylsulfonyl)phenoxymethyl] styrene (m and p represent mixtures)-N-t-butyl acrylic amide copolymer (15:85)

In order to improve the coloring property, white background, image storage stability and sweating durability, it is preferable to add a compound represented by the following Formula 1 to the light-sensitive material of the present invention.

Formula 1

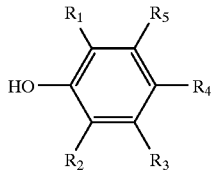

wherein $R_1$ is a tertiary alkyl group; $R_2$ is a primary or a secondary alkyl group; $R_3$, $R_4$ and $R_5$ are each an alkyl group, an alkoxycarbonyl group, a phenoxycarbonyl group, an alkoxy group, a phenoxy group or a phenylthio group, the groups represented by $R_1$, $R_3$, $R_4$ or $R_5$ each may have a substituent and the group represented by $R_2$ may has a substituent other than a phenyl group.

In the above-given Formula 1, $R_1$ represents a tertiary alkyl group, such as a t-butyl group, a t-pentyl group and a t-octyl group and, preferably, a t-butyl group; $R_2$ represents a primary or secondary alkyl group, such as a methyl group, an ethyl group and an isopropyl group and, preferably, a methyl group, provided, $R_2$ may be substituted by a substituent, but shall not be substituted by any phenyl group; and $R_3$, $R_4$ and $R_5$ represent each a hydrogen atom an alkyl group, such as a methyl group, an ethyl group, a butyl group and a dodecyl group, an alkoxycarbonyl group, such as an ethoxycarbonyl group, a phenoxycarbonyl group, such as a 2,4-di-t-butylphenoxycarbonyl group, an alkoxy group, such as a 2-ethylhexyloxy group, a phenoxy group, such as a 4-(2-ethylhexyl)phenoxy group and a 4-dodecyl-phenoxy group, a phenylthio group, such as a 3-t-butyl-4-hydroxy-5-methylphenylthio group.

The groups represented by the above-given $R_1$ through $R_5$ may be each substituted by a substituent. The groups represented by $R_4$ are each preferably an alkyl group.

Furthermore, it is preferable that the group represented by $R_4$ has the following group as a substituent;

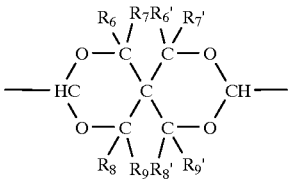

wherein $R_6$, $R_6'$, $R_7$, $R_7'$, $R_8$, $R_8'$, $R_9$ and $R_9'$ are each a hydrogen atom, an alkyl group or a phenyl group.

Among the compounds of Formula 1 which have the above group, those represented by the following Formula 1a or 1b are particularly preferable and those represented by Formula 1b are most preferable.

Formula 1a

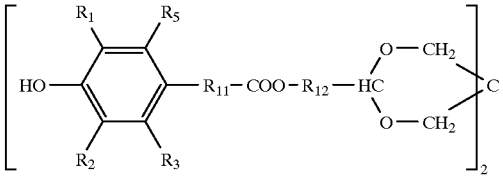

Formula 1b

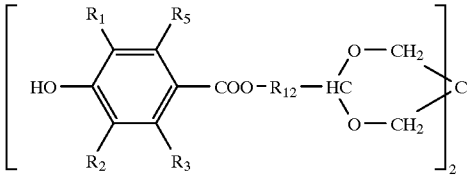

In the above, $R_1$, $R_2$, $R_3$ and $R_5$ are each the same as $R_1$, $R_2$, $R_3$ and $R_5$ defined in Formula 1; and $R_{11}$ and $R_{12}$ are each an alkylene group such as ethylene group and isobutylene group.

The compounds represented by Formula 1 may also be used together with other anti-discoloring agents in combination.

A compound represented by the following formula 2 is also preferable.

Formula 2

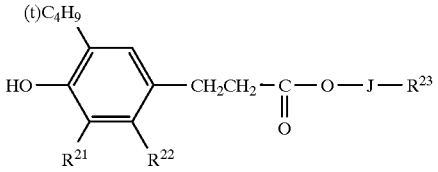

wherein $R^{21}$ and $R^{22}$ independently represent a hydrogen atom or an alkyl group having 1 to 5 carbon atoms; J represents an alkylene group or a simple bond; $R^{23}$ represents a heterocyclic residue.

Next, the compounds represented by formulas I and II are described below.

Examples of alkyl groups for $R^{21}$ and $R^{22}$ in Formula 2 include a methyl group, an ethyl group, a propyl group, a butyl group and an amyl group, which alkyl groups may be branched. Examples of alkylene groups for J include alkylene groups having 1 to 20 carbon atoms, such as a methylene group, an ethylene group, a propylene group and a butylene group, which alkylene groups may be branched. Examples of heterocyclic residues for $R^{23}$ include 5- or 6-membered ring residues containing a herero atom such as of oxygen, sulfur or nitrogen, e.g., a thienyl group, a furyl group, a pyrrolyl group, a pyrrolidinyl group, a piperidyl group, a piperazinyl group, a morpholino group, a thiacyclohexyl group, a dithiacyclohexyl group, an oxacyclohexyl group and a dioxacyclohexyl group, which heterocyclic residues may have been condensed with another heterocyclic ring or a hydrocarbon ring and may have formed a spiro compound.

The compounds represented by Formula 1 or Formula 2 may also be added to any one of the light sensitive layers and non-light sensitive layers of light-sensitive material and, they are preferably added to at least one of the light-sensitive layers. As a light-sensitive layer, in which the compound of Formula 1 to be added, a blue-sensitive layer or red-sensitive layer is preferable and the blue-sensitive layer is more preferable. Adding amount of the compound of Formula 1 is preferably 0.01 g to 30 g, more preferably 0.05 to 0.2 g, per square meter of the light-sensitive material.

The preferable example of the compound represented by the formula 1 is that having an ester group. The oxidation potential of the compound represented by the Formula 1 or Formula 2 is preferably in the range from 800 to 1800 mV, more preferably from 1200 to 1600 mV. and redox potential being not more than 1800 mV.

The oxidation potential is defined to be obtained by cyclic voltammetry. Oxidation potential can be determined by taking a cyclic voltamogram at a sweeping speed of 50 mV/second in acetonitrile solvent at 20° C., using platinum for a working electrode, an indicator electrode and saturated calomel for a reference electrode and tetra-n-butylammonium perchlorate as a supporting electrolyte.

Examples of the compound are given below.

1-1

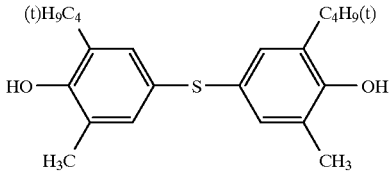

-continued
1-2
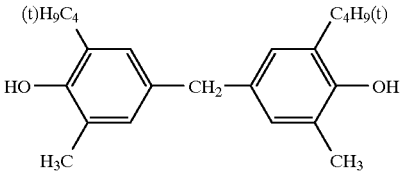
1-3
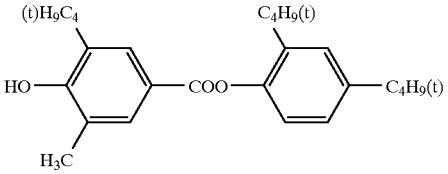
1-5
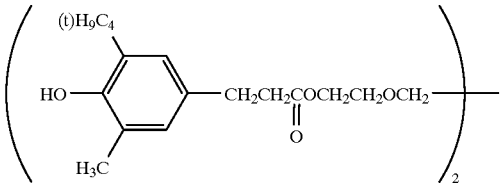
1-6
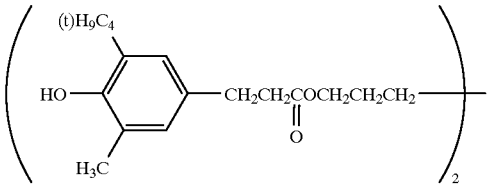
1-7
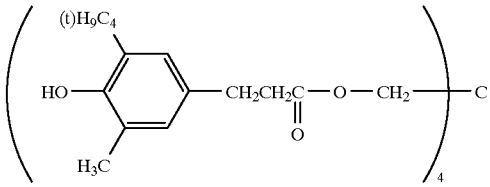
1-8
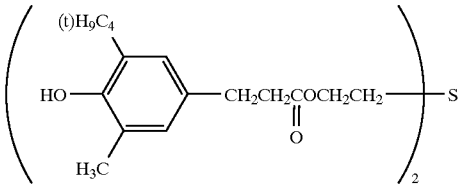
1-9
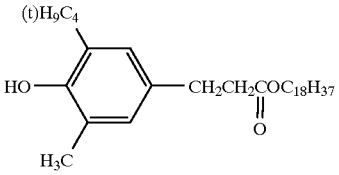

-continued
1-10
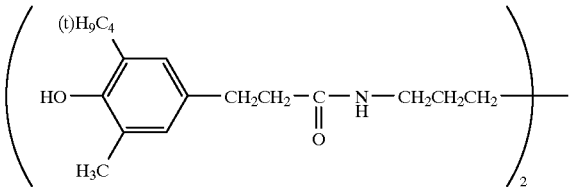
1-11
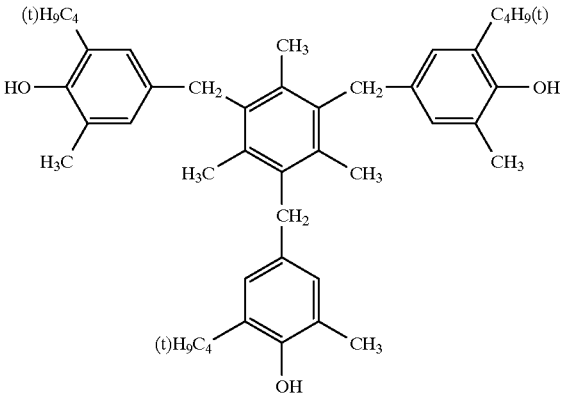
1-12
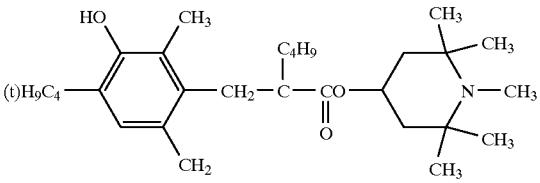
1-13
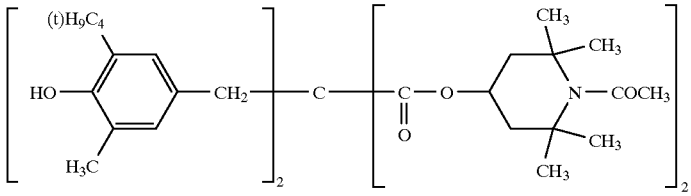
1-14
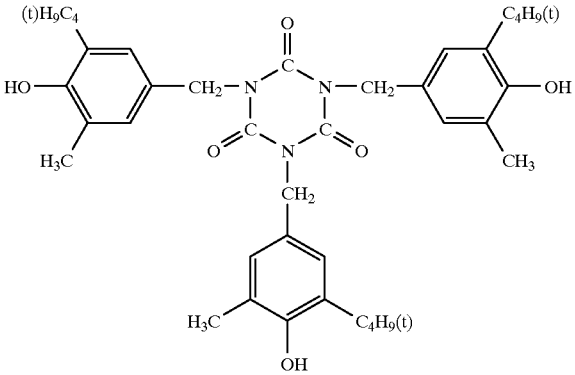

-continued
1-15
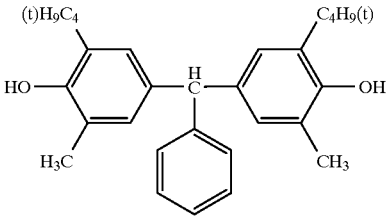
1-16
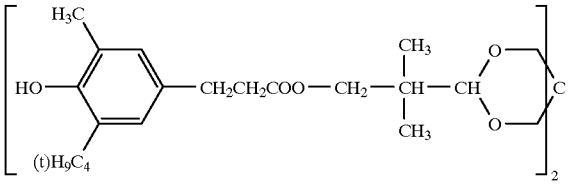
1-17
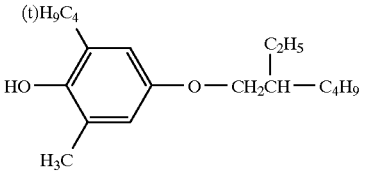
1-18
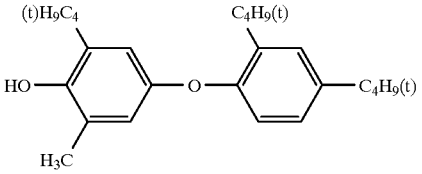
1-19
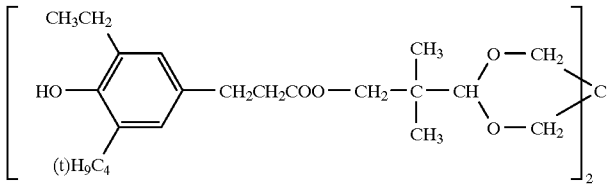
1-20
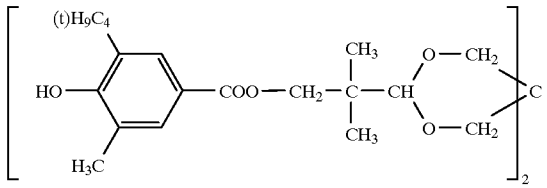
1-21
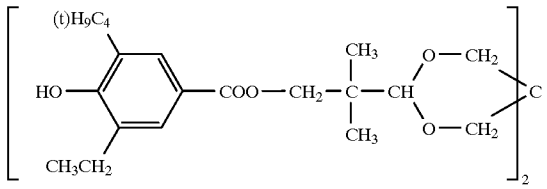

-continued
2-1
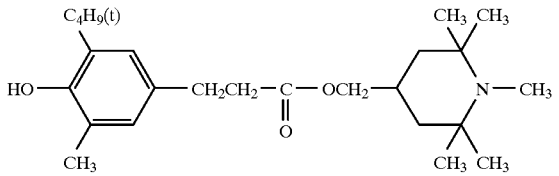
2-2
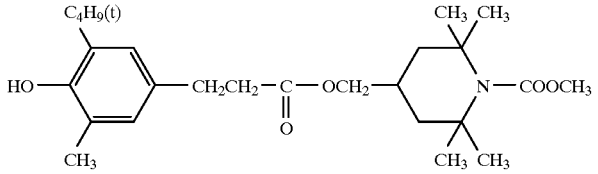
2-3
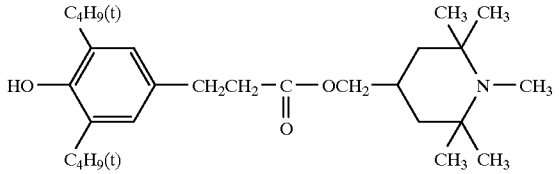
2-4
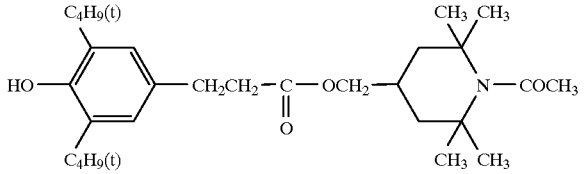
2-5
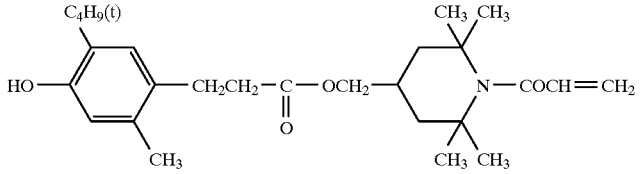
2-6
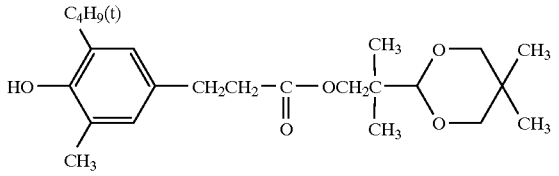
2-7
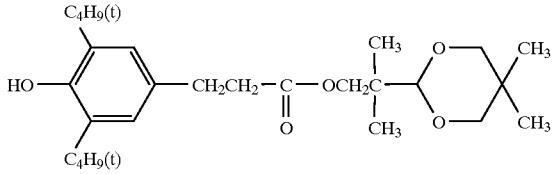

-continued
2-8
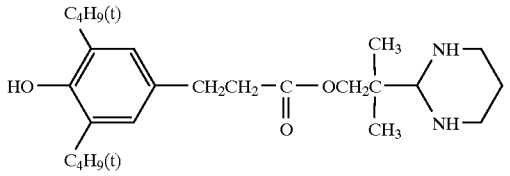
2-9
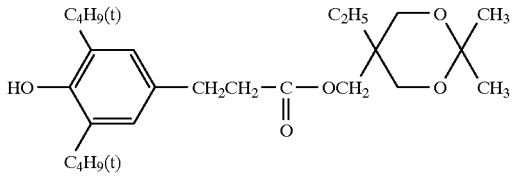
2-10
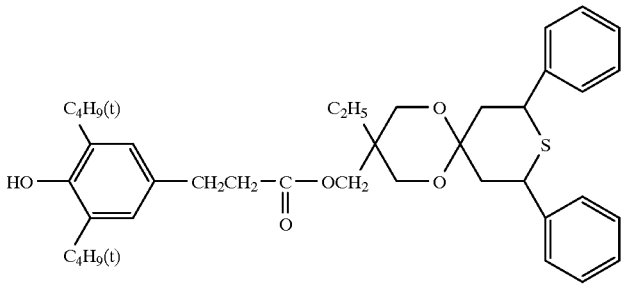
2-11
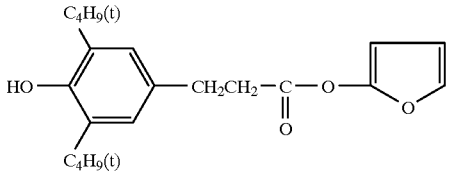
2-12
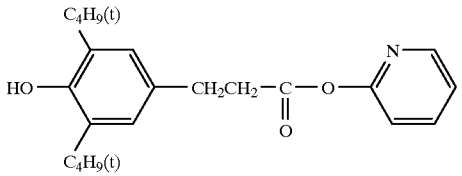
2-13
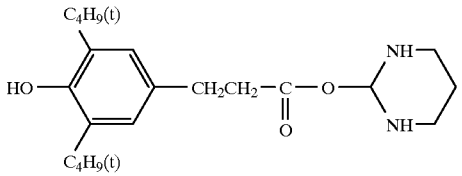
2-14
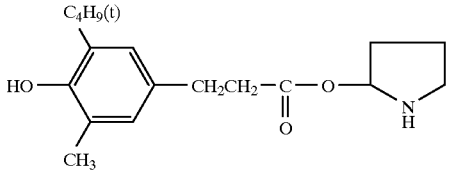

-continued
2-15
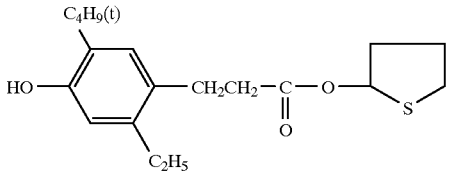
2-16
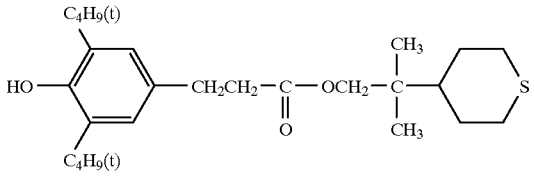
2-17
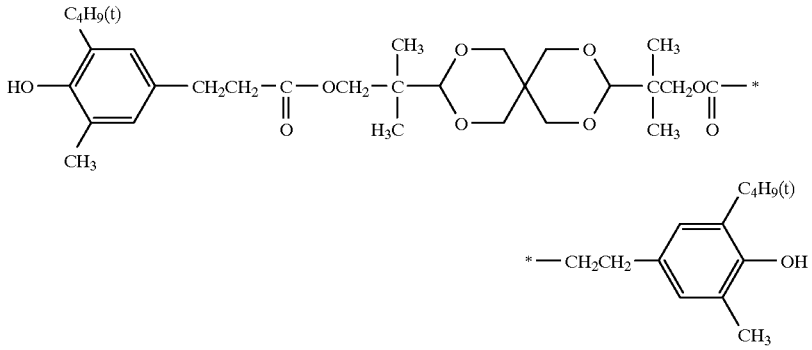
2-18
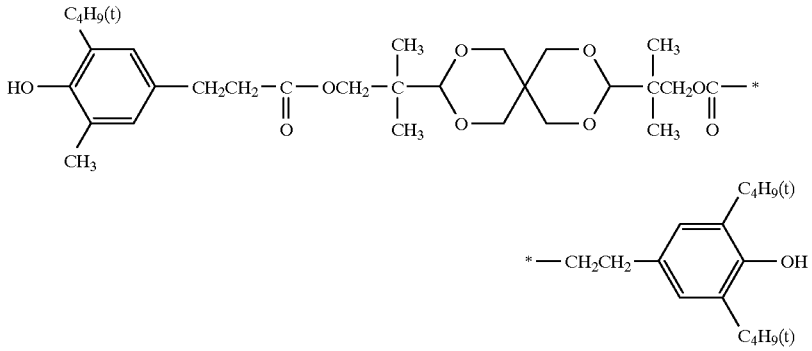
2-19
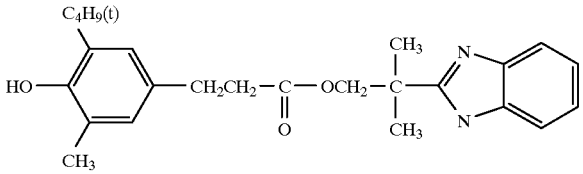

-continued 2-20

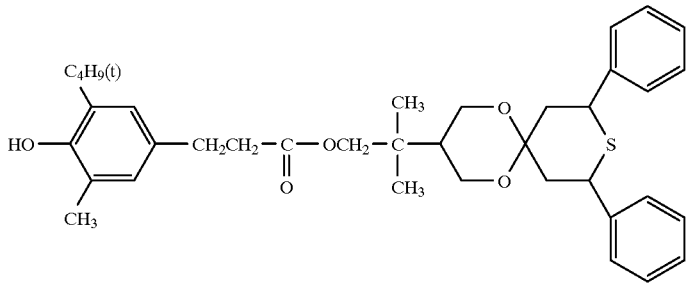

The preferable example is specifically compound 2-17.

The compound mentioned above is preferably contained in the emulsion layer containing the yellow coupler. The preferable amount is $0.03\times10^{-3}$ to $0.5\times10^{-3}$ mol/m$^2$, more preferably, $0.05\times10^{-3}$ to $0.3\times10^{-3}$ mol/m$^2$.

As a preferable embodiment of the present invention, an anti-staining agent is contained in a yellow coupler containing layer by 1–5 mol % against aforesaid yellow coupler. Aforesaid anti-staining agent is a compound capable of capturing an oxidation product of a color developing agent, and which is preferably a reducing agent capable of cross-oxidizing-reacting with aforesaid oxidized product. From another viewpoint, it is a compound which hinders coloring of a coupler by reacting with a coupler competitively. As such a compound, hydroquinone derivatives including 2,5-di-t-octyl hydroquinone, 2,5-di-s-dodecyl hydroquinone, 2,5-di-s-tetradecyl hydroquinone, 2-s-tetradecyl-5-s-dodecyl hydroquinone and 2-5-di-(4-hexyloxycarbonyl-t-hexyl) hydroquinone, gallic acid derivatives, 2,4-disulfonamide phenol derivatives and hydrazine derivatives are cited. The following compounds represented by Formula HQ-I are preferably used.

Formula HQ-I

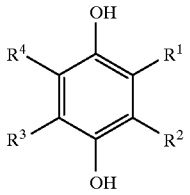

In Formula HQ-I, $R^1$, $R^2$, $R^3$ and $R^4$ independently represent a hydrogen atom, a halogen atom, an alkyl group, an alkenyl group, an aryl group, a cycloalkyl group, an alkoxy group, an aryloxy group, an alkylthio group, an arylthio group, an acyl group, an alkylacylamino group, an arylacylamino group, an alkylcarbamoyl group, an arylcarbamoyl group, an alkylsulfonamide group, an arylsulfonamide group, an alkylsulfamoyl group, an arylsulfamoyl group, an alkylsulfonyl group, an arylsulfonyl group, a nitro group, a cyano group, an alkoxycarbonyl group, an aryloxycarbonyl group, an alkylacyloxy group or an arylacyloxy group.

In atoms or groups represented by $R^1$, $R^2$, $R^3$ and $R^4$, as a halogen atom, a fluorine atom, a chlorine atom and a bromine atom are cited. As an alkyl group, for example, a methyl group, an ethyl group, a propyl group, an i-propyl group, a butyl group, a t-butyl group, an amyl group, an i-amyl group, an octyl group, a dodecyl group and an octadecyl group are cited. Specifically, an alkyl group having 1 to 32 carbons are preferable.

As an alkenyl group, for example, an allyl group, an octenyl group and an oleyl group are cited. Specifically, an alkenyl group having 2–32 carbons is preferable.

As an aryl group, a phenyl group and a naphtyl group are cited.

As an acyl group, for example, an acetyl group, an octanoyl group and a lauloyl group are cited.

As a cycloalkyl group, a cycloalkyl group and a cyclopentyl group are cited.

As an alkoxy group, for example, a methoxy group, an ethoxy group and a dodecyloxy group are cited. As an aryloxy group, for example, a phenoxy group is cited. As an alkylthio group, for example, a methylthio group, a butylthio group and a dodecylthio group are cited. As an arylthio group, for example, a phenylthio group is cited. As an alkylacylamino group, for example, an acetylamino group is cited. As an arylacylamino group, for example, a benzoylamino group is cited. As an alkylcarbamoyl group, for example, a methylcarbamoyl group is cited. As an arylcarbamoyl group, for example, a phenylcarbamoyl group is cited. As an alkylsulfonamide group, for example, a methylsulfonamide group is cited. As an arylsulfonamide group, for example, a phenylsulfonamide group is cited. As an alkylsulfamoyl group, for example, a methylsulfamoyl group is cited. As an arylsulfamoyl group, for example, a phenylsulfamoyl group is cited. As an alkylsulfonyl group, for example, a methylsulfonyl group is cited. As an arylsulfonyl group, for example, a phenylsulfonyl group is cited. As an alkyloxycarbonyl group, for example, a methyloxycarbonyl group is cited. As an aryloxy carbonyl group, for example, a phenyloxycarbonyl group is cited. As an alkylacyloxy group, for example, an acetyloxy group is cited. As an arylacyloxy group, for example, benzoyloxy group is cited.

The above-mentioned groups include those having a substituent. As aforesaid substituent, an alkyl group, an aryl group, an aryloxy group, an alkylthio group, a cyano group, an acyloxy group, an alkoxycarbonyl group, an acyl group, a sulfamoyl group, a hydroxyl group, a nitro group, an amino group and heterocycle are cited.

At least one of groups represented by $R^1$ and $R^3$ is a group in which the sum of the carbon number is 4 or more.

Preferably, an alkyl group and a branched-chained alkyl group having 4 or more carbons, preferably 6 to 18 carbon atoms. Preferably, $R^2$ and $R^4$ are hydrogen atom.
Hereinafter, practical examples of compounds represented by Formula HQ-I will be exhibited.
HQ-1
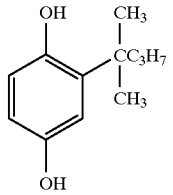
HQ-2
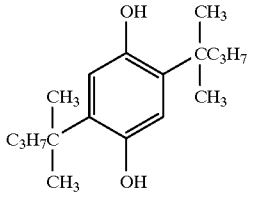
HQ-3
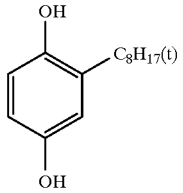
HQ-4
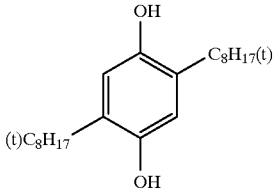
HQ-5
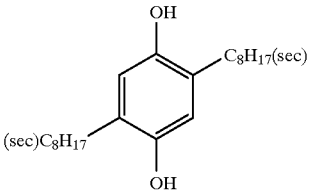
HQ-6
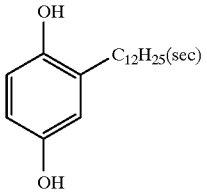
-continued
HQ-7
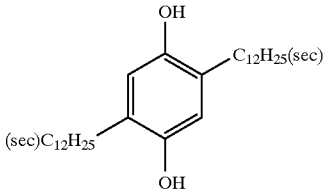
HQ-8
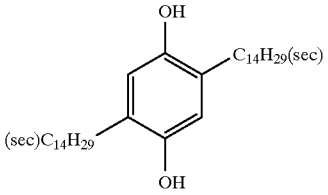
HQ-9
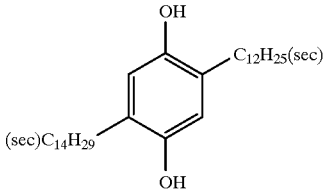
HQ-10
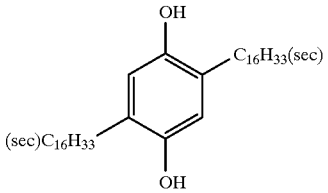
HQ-11
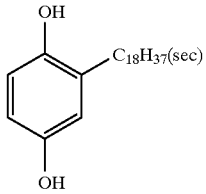
HQ-12
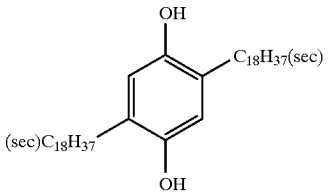
HQ-13
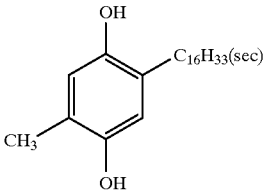

-continued
HQ-14
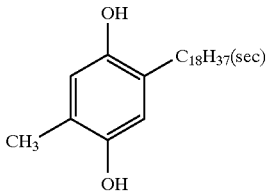
HQ-15
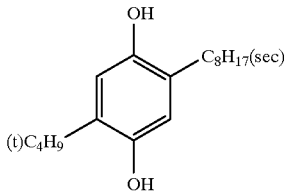
HQ-16
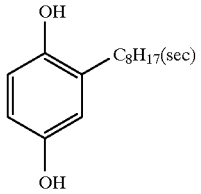
HQ-17
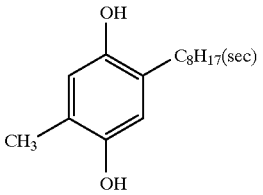
HQ-18
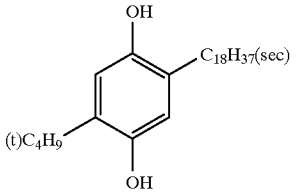
HQ-19
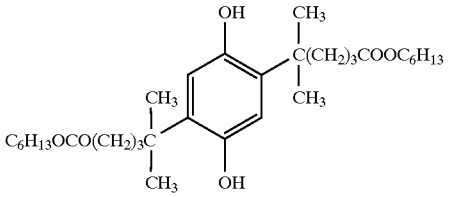
HQ-20
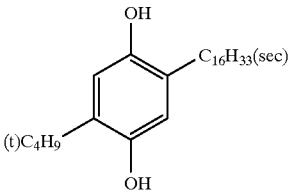
-continued
HQ-21
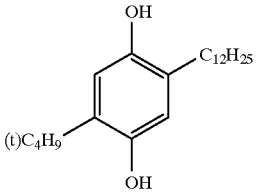
HQ-22
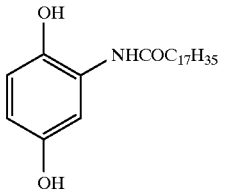
HQ-23
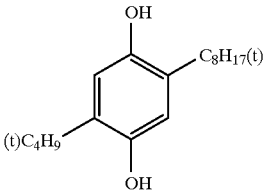
HQ-24
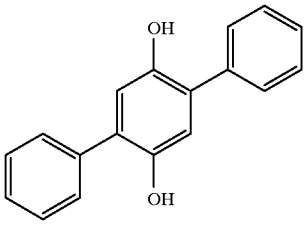
HQ-25
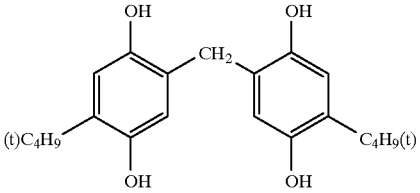
HQ-26
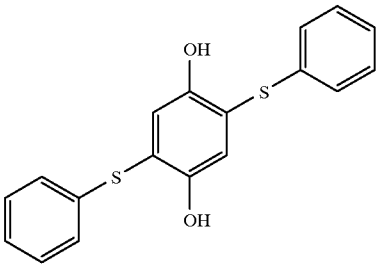

-continued

HQ-27

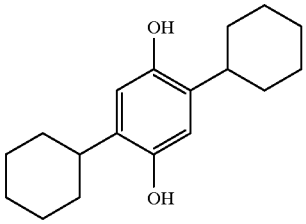

HQ-28

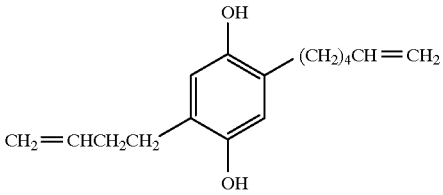

HQ-29

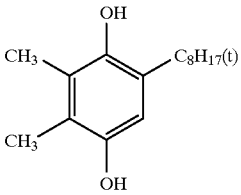

HQ-30

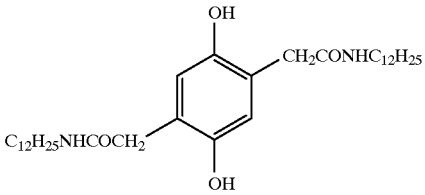

HQ-31

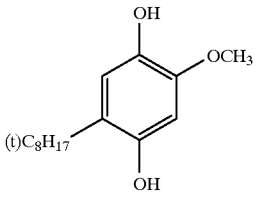

HQ-32

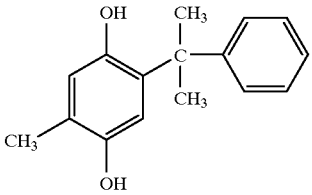

HQ-33

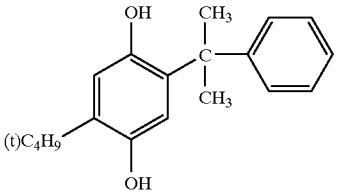

-continued

HQ-34

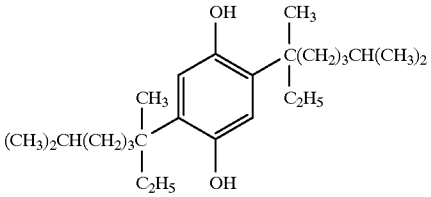

HQ-35

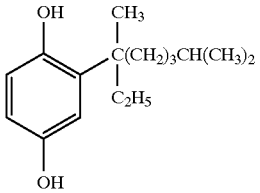

HQ-36

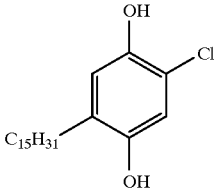

The above-mentioned compounds may be dissolved in the polymer together with a yellow coupler for emulsification and dispersing. Or, they may be dissolved in the polymer or high boiling solvent independently from the yellow coupler to be emulsified and dispersed for addition. They are preferably dissolved in the same polymer together with a yellow coupler.

Compounds represented by Formula B will be explained.

In Formula B, as a straight-chained or branched alkyl group represented by $R_{11}$, $R_{12}$ and $R_{13}$, for example, a methyl group, an ethyl group, a propyl group, an iso-propyl group, a butyl group, a sec-butyl group, a tert-butyl group, a pentyl group, a tert-pentyl group, a hexyl group, an octyl group, a tert-octyl group, a nonyl group, a decyl group, a dodecyl group, a tert-dodecyl group, a sec-tetradecyl group, an iso-palmytyl group, a stearyl group and an iso-stearyl group are cited.

An alkyl group represented by $R_{14}$ represents identical groups as $R_{11}$, $R_{12}$ and $R_{13}$. They may have a substituent. As a halogen atom represented by $R_{14}$, a fluorine atom, a chlorine atom, a bromide atom and iodine atom are cited.

In B's preferable example, n represents 0; either $R_{11}$, or $R_{12}$ are a hydrogen atom. In specifically preferable example, n represents 0; both of $R_{11}$ and $R_{12}$ are hydrogen atoms; and $R_{13}$ is a branched alkyl group (namely, a phenol compound having a branched alkyl group only at a para-position). In still more preferable example, n represents 0; both of $R_{11}$ and $R_{12}$ are hydrogen atoms. In the most preferable example, n represents 0; and $R_{11}$ and $R_{12}$ are hydrogen atoms.

Typical practical examples of compounds represented by Formula B are shown.

(B-1)
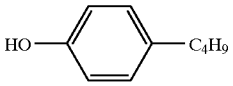
(B-2)
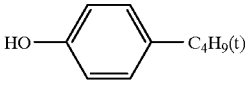
(B-3)
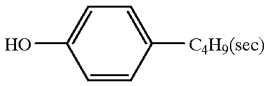
(B-4)
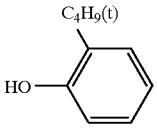
(B-5)
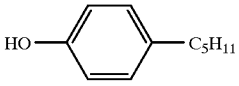
(B-6)
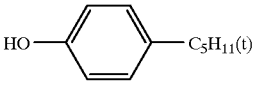
(B-7)
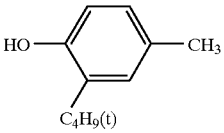
(B-8)
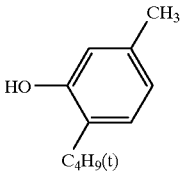
(B-9)
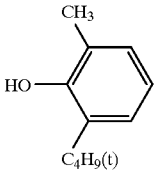
(B-10)
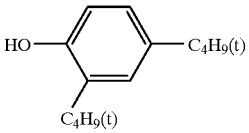
-continued
(B-11)
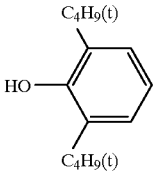
(B-12)
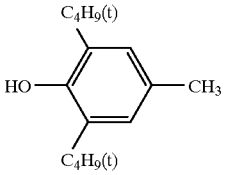
(B-13)
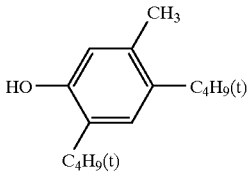
(B-14)
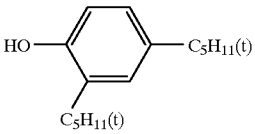
(B-15)
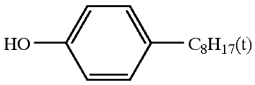
(B-16)
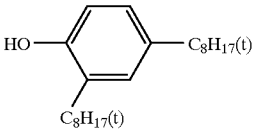
(B-17)
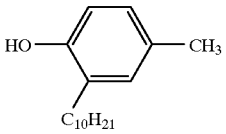
(B-18)
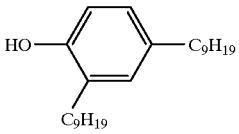
(B-19)
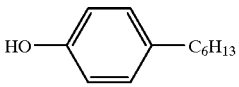

-continued (B-20)

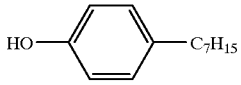

(B-21)

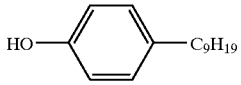

(B-22)

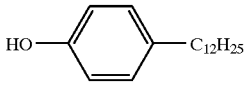

(B-23)

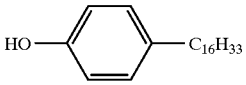

(B-24)

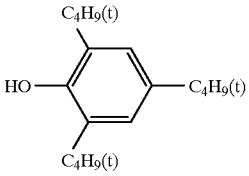

Compounds represented by Formula (B) can be used in a range of $1\times10^{-2}$–5 mol and preferably $5\times10^{-2}$–2 mol per mol of the yellow coupler.

The above-mentioned compounds may be added to the polymer together with a yellow coupler for emulsification and dispersing. Or, they may be added to the polymer or high boiling solvent independently from the yellow coupler to be emulsified and dispersed. They are preferably added to the same polymer together with a yellow coupler for emulsification.

The yellow coupler may be emulsified with at least one kind of high boiling solvent in addition to the polymer. "High boiling solvent" referred to as here means a solvent whose boiling point is 100 ° C. or higher. A water-insoluble high boiling organic solvent whose boiling point is 150° C. or higher is preferable. It is preferable that the high boiling solvent has dielectric constant of 3.0 or more and less than 6.0. The dielectric constant is that at 30° C. The high boiling organic solvent preferably used includes phthalic acid esters, phosphoric acid esters, phosphonic acid esters, benzoic acid esters, aliphatic acid esters, organic acid amides, ethers, phenols, ethers and ketones.

Hereinafter, practical examples of the above-mentioned high boiling organic solvent will be exhibited.

H-1

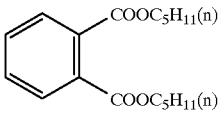

-continued

H-2

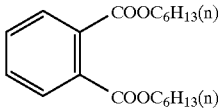

H-3

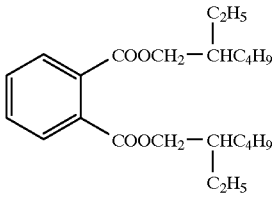

H-4

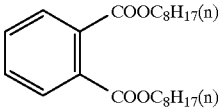

H-5

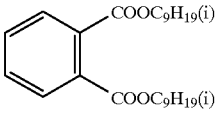

H-6

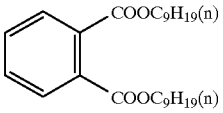

H-7

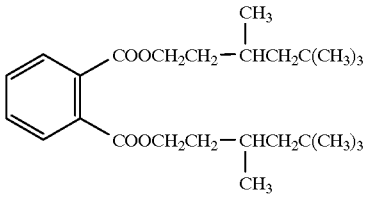

H-8

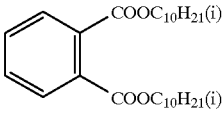

H-9

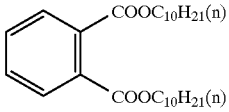

H-10

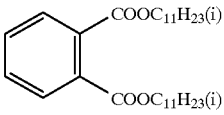

H-11

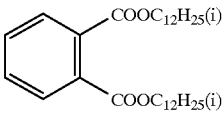

-continued

H-12

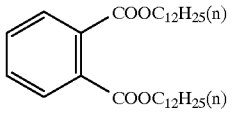

H-13

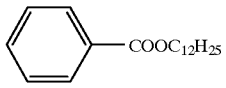

H-14

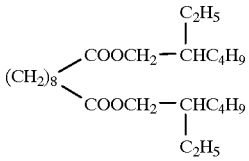

H-15

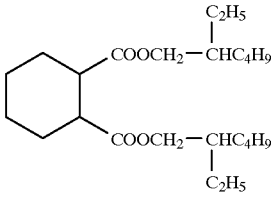

H-16

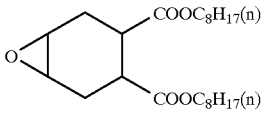

H-17

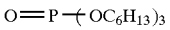

H-18

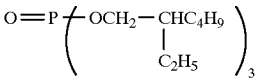

H-19

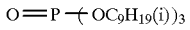

H-20

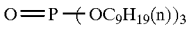

H-21

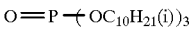

H-22

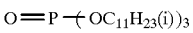

H-23

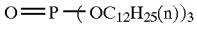

H-24

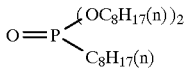

H-25

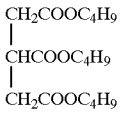

-continued

H-26

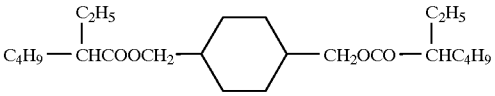

"High boiling organic solvent amount/coupler amount (weight ratio) in a high boiling solvent dispersed product in which the yellow coupler is dissolved is preferably 0.05–0.8 and more preferably 0.1–0.4.

When emulsifying and dispersing a coupler, it is emulsified together with the polymer, and a high boiling organic solvent used as necessary. The coupler, the polymer or the high boiling organic solvent may be dissolved in a low boiling and/or a high boiling organic solvent as necessary when they are emulsified. The coupler is emulsified and dispersed using a surfactant in a hydrophilic binder such as an aqueous gelatin solution. As a dispersing means, a stirrer, a homogenizer, a colloid mill, a flow jet mixer and a ultrasonic disperser can be used. A process of removing aforesaid low boiling organic solvent may be applied after dispersion or concurrently with dispersion.

As the low boiling organic solvent, ethyl acetic acid, butyl acetic acid, ethyl propionic acid, secondary butyl alcohol, methylethylketone, methylisobutylketone, β-ethoxyethylacetate, methylcelosolveacetate and cyclohexanone are cited. As a water-soluble organic solvent, methyl alcohol, ethyl alcohol, acetone and tetrahydrofurane are cited. Two or more kind of the above-mentioned organic solvents can be used as necessary.

With regard to the yellow coupler of the present invention, the silver amount/coupler amount (mol ratio) in the silver halide emulsion contained in the identical layer is 2.2–3.7, and preferably 2.4–3.2. The amount of coupler referred to here means the total amount of yellow coupler, and is not limited to the amount of the coupler represented by Formula (I).

By controlling the high boiling organic solvent amount/coupler amount and the yellow coupler coating amount and the silver coating amount/the coupler coating amount in the above-mentioned range, collapse of the color balance of the image due to color fading caused by storage, specifically sun light, after the dye image has been formed can easily be prevented. Concurrently with this, low fogging at high Dmax, excellent reciprocity law failure, stable and excellent gradation reproducibility, minimal coating defect and anti-scratch property can easily be provided.

The amount of gelatin in the layer containing the yellow coupler is preferably 0.80–1.50 g/m$^2$, and more preferably 1.00–1.30 g/m$^2$.

From a viewpoint of high coloring property in rapid processing, it is preferable that the silver chloride content of a silver halide emulsion is 95 mol % or more. In aforesaid range, the silver halide emulsion may have arbitrary halogen composition such as silver chloride, silver bromoiodide, silver bromochloroiodide and silver iodochloride. Substantially, silver bromochloride not containing silver iodide is preferable. In terms of rapid processability, the silver halide emulsion containing silver chloride of preferably 97 mol % or more and more preferably 98–99.9 mol% or more.

In order to obtain the silver halide emulsion used for the present invention, a silver halide emulsion having a portion where silver bromide is contained in high density. In this occasion, the portion where silver bromide is contained in high density may be epitaxy joint with silver halide grains or may form a so-called core/shell structure. In addition, it does not form a complete layer in which regions where composition is different partially may exist. Incidentally, composition may vary continuously or uncontinuously. It is specifically preferable that the portion where silver bromide is contained in high density is the vertex of crystal grains on the surface of silver halide grains.

In order to obtain the silver halide emulsion used for the present invention, it is advantageous to incorporate bimetal ion. As a bimetal ion capable of being used for aforesaid purpose, metals participating in 8th through 10th periodic law such as iron, iridium, platinum, palladium, nickel, rhodium, osmium, rhutenium and cobalt, transition metals participating in 12th periodic law such as cadmium, zinc and mercury and each ion of lead, rhenium, molybdenum, gallium and chrome. Of these, metallic ions such as iron, iridium, platinum, rhutenium, gallium and osmium are preferable.

Aforesaid metallic ions may be added to the silver halide emulsion in forms of salt and complex salt.

When the above-mentioned bimetallic ions form a complex salt, as its ligand or ion, cyanide ion, thiocyanate ion, cyanate ion, chloride ion, bromide ion, iodide ion, nitrate ion, carbonyl and ammonia are cited. Of these, a cyanide ion, thiocyante ion, cyanate ion, chloride ion and bromide ion are preferable.

In order to incorporate a bimetallic ion in the silver halide emulsion, aforesaid bimetallic compound may add at an arbitrarily step including prior to forming the silver halide grains, during forming the silver halide grains and during physical ripening processing after forming the silver halide grains. In order to obtain the silver halide emulsion satisfying aforesaid conditions, a bimetallic compound may be dissolved together with a halogenated salt and may be added continuously whole through entire grain formation process or at a part thereof.

The amount of the above-mentioned bimetallic ion when being added to the silver halide emulsion is preferably $1\times10^{-9}$ mol or more and $1\times10^{-2}$ mol or less, and specifically preferably $1\times10^{-8}$ mol or more and $5\times10^{-5}$ mol or less.

The preparation of the silver halide grains used for the present invention may be arbitrary. In addition, by the use of methods described in references such as U.S. Pat. Nos. 4,183,756 and 4,225,666 and Japanese Patent O.P.I. Publication No. 26589/1980, Japanese Patent Publication No. 42737/1980 and The Journal of Photographic Science (J. Photogr. Sci) Nos. 21 and 39 (1973), grains having forms of octahedral, tetradecahedral and dodecahedral are formed to be used. In addition, grains having twinned plane may be used.

The silver halide emulsion wherein 50% or more and preferably 80% or more of the total external surface of emulsion grains comprises (111) planes, from the viewpoint of fluctuation of Dmax. These can be calculated by means of an electron microscope in terms of area ratio of 200 or more grains. The shape of the above-mentioned silver halide grain of the above-mentioned emulsion is not specifically limited.

In addition, emulsion grains which comprise a tabular type whose aspect ratio is 3 or more and wherein 50% or more of the total projected area of the emulsion grain is tabular are preferable from the viewpoint of Dmax.

The silver halide grains used for the present invention may be grains of a single form. Specifically, it is preferable to add two or more kind of mono-dispersed silver halide emulsion to an identical layer.

There is no limit to grain size of the silver halide grains used for the present invention. However, if considering other photographic performances such as rapid processability and speed, 0.1–1.2 $\mu$m is preferable, and 2–1.0 $\mu$m is more preferable.

Aforesaid grain size can be measured using projected area or diameter approximate value of the grains. If the grains are substantially uniform, the grain size distribution can be represented considerably accurately in terms of diameter or projected area.

The silver halide grains used for the present invention is a mono-dispersed silver halide grains in which variation coefficient of 0.22 or less and preferably 0.15 or less. It is specifically preferable to add two or more kind of mono-dispersed emulsion whose variation coefficient is 0.15 or less to an identical layer.

Here, variation coefficient is a coefficient representing the width of grain size distribution, and defined by the following equation:

$$\text{Variation coefficient}=S/R$$

wherein S represents a standard deviation of grain size distribution; and R represents an average grain size.

Here, "grain size" means a diameter of the silver halide grains when it is spherical. When the form of grain cubic or other than spherical, it means a diameter of a projected image when it is converted to a circle.

As a preparation device and method of the silver halide emulsion, various conventional ones known by those skilled in the art can be used.

The silver halide emulsion used for the present invention may be obtained any of an acid method, a neutral method and an ammonia method. Aforesaid grains may be grown at one step. They may be grown after forming seed grains. How to produce seed grains and how to grow grains may be the same or different.

As a method of reacting a soluble silver salt and a soluble halogenated substance salt, any methods including a normal precipitation method, a reverse precipitation method, a double jet method and their mixture may be used. It is preferable to use the double jet method. In addition, as one type of the double jet method, a pAg controlled double jet method described in Japanese Patent O.P.I. Publication No. 48521/1979 may be used.

With regard to reacting device, a device disclosed in Japanese Patent O.P.I. Publication Nos. 92523/1982 and 92524/1982 wherein a water-soluble silver salt and an aqueous water-soluble halogenated substance salt solution are fed from an addition sub-device which is located in a reacting initial solution, a device disclosed in German Open Patent No. 2921164 wherein the density of a water-soluble silver salt and an aqueous water-soluble halogenated substance salt solution are continuously changed to be added and a device disclosed in Japanese Patent Publication No. 501776/1981 wherein a reacting initial solution is taken up to outside of the reacting vessel and grains are formed while keeping distance between each silver halide grain by condensating grains by means of an ultrafiltration method may be used.

If necessary, a silver halide solvent such as thioether may be used. In addition, a compound having a mercapto group or a compound such as a nitrogen-containing compound or a sensitizing dye may be added during forming silver halide grains or after finish of forming the grains.

In order to improve sensitivity fluctuation and storage stability caused by humidity change before exposure, a compound represented by the following Formula IV and/or V may be added.

The compound represented by Formula IV is described below, which is comprised of a pyrimidine nucleus and at least on mercapto group.

Formula IV

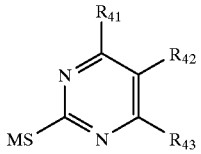

In the formula, M is a hydrogen atom, an alkali metal atom or a quartenary ammonium group; $R_1$, $R_2$ and $R_3$ are each independently a hydrogen atom, a halogen atom, an alkyl group, an alkenyl group, an alkoxy group, an aryl group, a hydroxyl group, a mercapto group, a phosphono group, an amino group, a nitro group, a cyano group, an alkoxycarbonyl group, an aryloxycarbonyl group, a carbamoyl group or a sulfamoyl group; $R_{41}$ and $R_{42}$, or $R_{42}$ and $R_{43}$ are each may be bonded to form a ring.

In Formula IV, the alkali metal atom represented by M includes lithium, sodium and potassium, and the quartenary ammonium group represented by M includes, for example, $NH_4$, $N(CH_3)_4$, $N(C_4H_9)_4$, $N(CH_3)_3C_{12}H_{25}$, $N(CH_3)_3C_{16}H_{33}$ and $N(CH_3)_3CH_2C_6H_5$.

The alkyl group, alkoxyl group, aryl group, amino group, alkoxycarbonyl group, aryloxycarbonyl group, carbamoyl group and sulfamoyl group represented by $R_{41}$, $R_{42}$ or $R_{43}$ are each may have a substituent.

Preferred examples of $R_{41}$ include a hydroxyl group, alkoxy group, aryloxy group and amino group.

Preferred examples of $R_{42}$ and $R_{43}$ include a hydrogen atom, amino group, hydroxyl group, alkoxyl group, alkyl group having 1 to 12 carbon atoms which may have a substituent, and aryl group having 6 to 12 carbon atoms which may have a substituent. It is preferred that the total number of carbon atoms contained in the groups of $R_{42}$ and $R_{43}$ is 1 to 20. Particularly preferred examples of groups represented by $R_{42}$ include a hydrogen atom, amino group including substituted amino group such as dimethylamino group and diethylamino group, alkyl group having 1 to 5 carbon atoms and aryl group having 6 to 12 carbon atoms, the alkyl and aryl groups each may have a substituent.

Examples of mercaptopyrimidine compound represented by Formula IV, hereinafter referred to pyrimidine compound of the invention, are shown below, but the compound of the invention is not limited thereto.

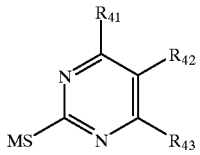

| | $R_{41}$ | $R_{42}$ | $R_{43}$ | M |
|---|---|---|---|---|
| IV-1 | H | H | OH | H |
| IV-2 | $CH_3$ | H | OH | H |
| IV-3 | $CH_3$ | H | SH | H |
| IV-4 | OH | H | OH | H |
| IV-5 | OH | $C_2H_5$ | OH | H |
| IV-6 | OH | 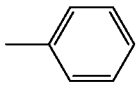 | OH | H |
| IV-7 | | 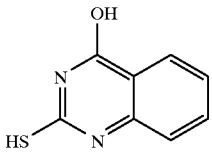 | | |
| IV-8 | | 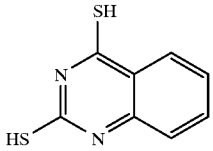 | | |

-continued
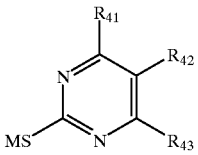
| | $R_{41}$ | $R_{42}$ | $R_{43}$ | M |
|---|---|---|---|---|
| IV-9 | 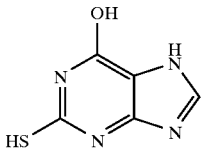 | | | |
| IV-10 | 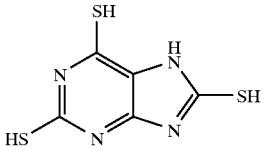 | | | |
| IV-11 | $CH_3$ | H | $CH_3$ | H |
| IV-12 | $C_2H_5$ | H | OH | H |
| IV-13 | $NH_2$ | H | $NH_2$ | H |
| IV-14 | H | $COOC_2H_5$ | OH | H |
| IV-15 | $NH_2$ | $NH_2$ | $NH_2$ | H |
| IV-16 | 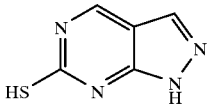 | | | |
| IV-17 | OH | $NHNH_2$ | $NH_2$ | H |
| IV-18 | $CH_3$ | $CH_2CH_2OH$ | OH | H |
| IV-19 | 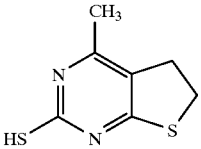 | | | |
| IV-20 | 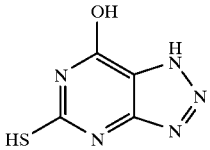 | | | |
| IV-21 | OH | NO | $NH_2$ | H |
| IV-22 | $CH(OC_2H_5)_2$ | H | OH | H |
| IV-23 | CH═NNHPh | H | OH | H |
| IV-24 | $OCH_3$ | H | $OCH_3$ | H |
| IV-25 | 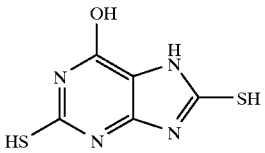 | | | |
| IV-26 | OH | H | $C_3H_7$ | H |
| IV-27 | $CH_2OCH_3$ | H | OH | H |
| IV-28 | OH | $CH_3$ | $C_3H_7$ | H |
| IV-29 | H | H | 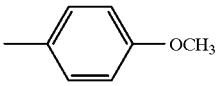 | H |
| IV-30 | OH | H | $NH_2$ | H |
| IV-31 | H | H | H | H |
| IV-32 | $CH_3$ | $C_5H_{11}$(i) | OH | H |

-continued

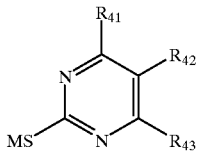

| | $R_{41}$ | $R_{42}$ | $R_{43}$ | M |
|---|---|---|---|---|
| IV-33 | 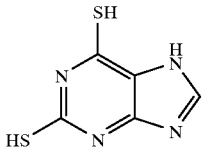 | | | |
| IV-34 | 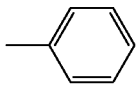 | H | $SC_2H_5$ | H |
| IV-35 | OH | 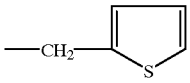 | H | H |
| IV-36 | OH | 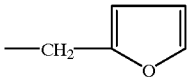 | H | H |

Although these mercaptopyrimidine compound are available on the market, they can be synthesized according to the method described in the following publications: "Journal of the Chemical Society" No, 1951, p. 1218, ibid. No. 1954, p. 4116, ibid. No. 1959, p. 1004, "Journal of American Chemical Society" vol. 82, p. 486, ibid. vol. 34, p. 175, ibid. vol. 40, p. 547, ibid. vol. 58, p. 769, ibid. vol. 67, p. 2197, ibid. vol. 70, p. 3109, ibid. vol. 76, p. 5087, ibid. vol. 78, p. 401, ibid. p. 78, p. 2858, ibid. vol. 79, p. 490, "Berichte" vol. 32, p. 2921, "Hervetica Chimica Acta" vol. 24, p. 1317, and "Compte Rend Hebdomadaire des Sciences de l'Academie de Sciences" vol. 240, p. 984.

The amount of the pyrimidine compound represented by Formula IV is preferably $2\times10^{-7}$ to $1\times10^{-2}$ moles, more preferably $2\times10^{-7}$ to $5\times10^{-3}$ moles, per mole of silver halide. Well known methods can be applied for adding the compound to the emulsion. For example, the compound may be added directly into the emulsion, or by a method by which the compound is added to the emulsion in a form of solution dissolved in a water-miscible solvent such as pyridine, methanol, ethanol, methyl cellosolve, acetone, fluorinated alcohol, dimetylformamide or their mixture, or in water. In the course of dissolving, ultrasonic wave may be applied.

Further a method described in U.S. Pat. No. 3,469,987, by which the compound is dissolved in a volatile organic solvent and dispersed in a solution of a hydrophilic colloid and added to the emulsion, and a method described in JP O.P.I. No. 46-24185/1971 by which the compound is directly dispersed in an aqueous medium without use of any solvent and added to the emulsion, may be applied. The compound of the invention may be added to the emulsion in a form of dispersion prepared by an alkali-dissolving dispersion method.

Formula V

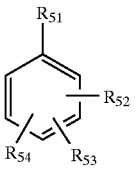

In the above formula, $R_{51}$ and $R_{52}$, which may be the same or different, are each a —$OR_{55}$ or —$N(R_{56})R_{57}$ in which $R_{55}$ is a hydrogen atom, an alkyl group, an aryl group or a heterocyclic group; $R_{53}$, $R_{54}$, $R_{56}$ and $R_{57}$, which may be the same or different, are each a hydrogen atom, an alkyl group, an aryl group, a heterocyclic group, a sulfonyl group, a carbonyl group, a carbamoyl group or a group accelerating adsorption with silver halide; provided that at least one of $R_{53}$, $R_{54}$, $R_{55}$, $R_{56}$ and $R_{57}$ is a group accelerating adsorption with silver halide or a group having a group accelerating adsorption with silver halide as a substituent.

In Formula V, the alkyl group represented by $R_{53}$, $R_{54}$, $R_{55}$, $R_{56}$ or $R_{57}$ includes, for example, methyl group, ethyl group, propyl group, t-butyl group, pentyl group, cyclopentyl group, hexyl group, cyclohexyl group, octyl group and dodecyl group.

The aryl group represented by $R_{53}$, $R_{54}$, $R_{55}$, $R_{56}$ or $R_{57}$ includes, for example, phenyl group and naphthyl group.

The heterocyclic group represented by $R_{53}$, $R_{54}$, $R_{55}$, $R_{56}$ or $R_{57}$ includes, for example, 2-pyridyl group, 3-pyridyl group, 4-pyridyl group, morpholyl group, piperidyl group, piperazyl group, selenazolyl group, sulfolanyl group, piperidinyl group, tetrazolyl group, thiazolyl group, oxazolyl group, imidazolyl group, thienyl group, pyrrolyl group, pyrazinyl group, pyrimidinyl group, pyridazinyl group, pyrimidyl group, pyrazolyl group and furyl group.

The sulfonyl group represented by $R_{53}$, $R_{54}$, $R_{56}$ or $R_{57}$ includes, for example, methylsulfonyl group, ethylsulfonyl group and phenylsulfonyl group.

The carbonyl group represented by $R_{53}$, $R_{54}$, $R_{56}$ or $R_{57}$ includes, for example, methylcarbonyl group, ethylcarbonyl group and phenylcarbonyl group.

The carbamoyl group represented by $R_{53}$, $R_{54}$, $R_{56}$ or $R_{57}$ includes, for example, methylcarbamoyl group, ethylcarbamoyl group and phenylcarbamoyl group.

The above-mentioned alkyl group, aryl group, heterocyclic group, sulfonyl group, carbonyl group and carbamoyl group each includes ones having a substituent. The groups each may be substituted with a halogen atom such as chlorine atom, bromine atom or fluorine atom; an alkyl group such as methyl group, ethyl group, propyl group, i-propyl group, pentyl group, cyclopentyl group, hexyl group, cyclohexyl group, octyl group or dodecyl group; an alkoxyl group such as methoxy group, ethoxy group, 1,1-dimethylethoxy group, hexyloxy group or dodecyloxy group; an aryloxy group such as phenoxy group or naphthyloxy group; an aryl group such as phenyl group or naphthyl group; an alkoxycarbonyl group such as methoxycarbonyl group, ethoxycarbonyl group, butoxycarbonyl group or 2-hexylcarbonyl group; an aryloxycarbonyl group such as phenoxycarbonyl group or naphthyloxycarbonyl group; a heterocyclic group such as 2-pyridyl group, 3-pyridyl group, 4-pyridyl group, morpholyl group, piperidyl group, piperadyl group, selenazolyl group, sulforanyl group, piperidinyl group, tetrazolyl group, thiazolyl group, oxazolyl group, imidazolyl group, thienyl group, pyrrolyl group, pyradinyl group, pyrimidinyl group, pyridadinyl group, pyrimidyl group, pyrazolyl group or furyl group; an amino group such as amino group, N,N-dimethylamino group or anilino group; a hydroxyl group; a cyano group; a sulfo group; a carboxyl group; or a sulfonamido group such as methylsufonylamino group, ethylsulfonylamino group, butylsulfonylamino group, octylsulfonylamino group or phenylsulfonylamino group.

The group accelerating adsorption to silver halide includes a group having a thioamide moiety such as a group derived from thiourea, thiourethane, dithiocarbamate, 4-thiazoline-2-thione, 2-thiohydantoin, rhodanine, thiobarbituric acid, tetrazoline-5-thione, 1,2,4-triazoline-3-thione, 1,3,4-thiadiazoline-2-thione, 1,3,4-oxadiazoline-2 -thione, benzimidazoline-2-thione, benzoxazoline-2-thione or benzothiazoline-2-thione; a group having a mercapto group and a sulfide moiety such as methylthio group, ethylthio group or phenylthio group; a group having a disulfide moiety such as methyldithio group, ethyldithio group or phenyldithio group; and a 5- or 6-member heterocyclic group such as a group derived from benzotriazole, triazole, tetrazole, indazole, benzimidazole, imidazole, benzothiazole, thiazole, banzoxazole, oxazole or triazine.

Concrete examples of the compound represented by Formula V are given below.

V-1

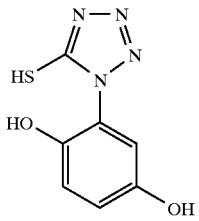

V-2

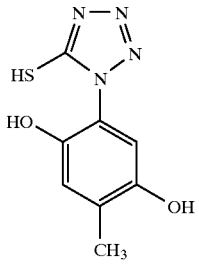

V-3

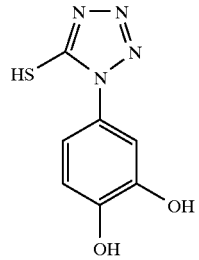

V-4

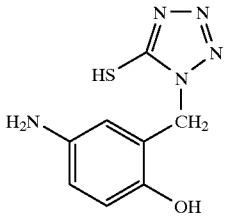

V-5

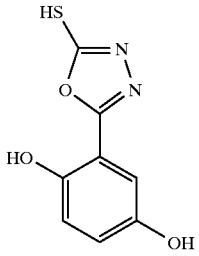

V-6

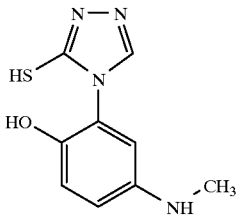

-continued
V-7
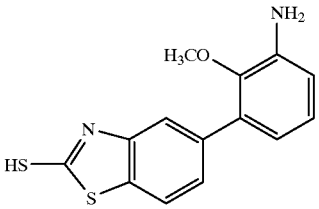
V-8
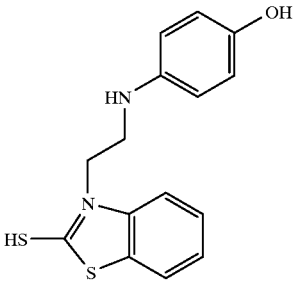
V-9
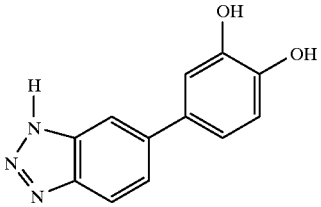
V-10
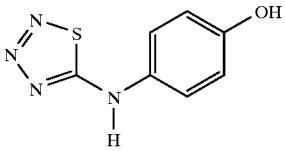
V-11
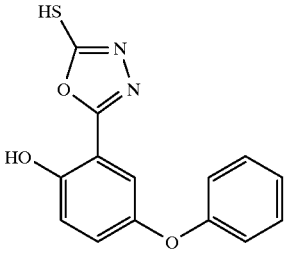
V-12
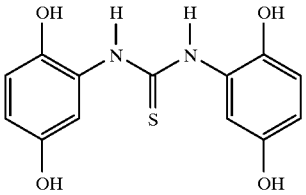
-continued
V-13
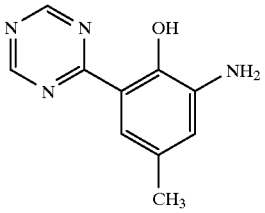
V-14
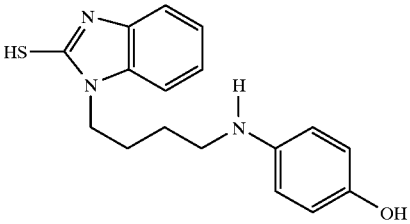
V-15
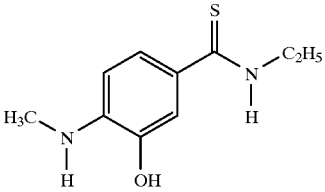
V-16
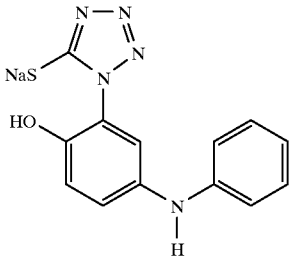
V-17
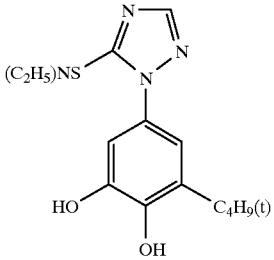

-continued

V-18

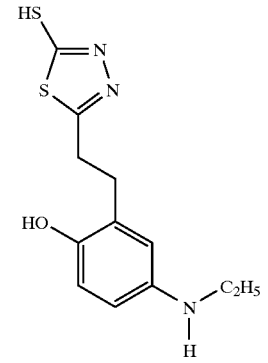

V-19

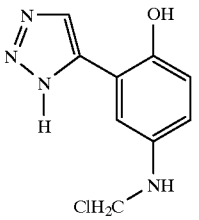

V-20

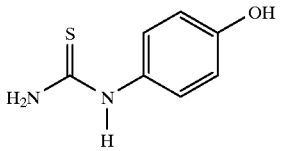

The compound represented by the formula V may be added on the step of grain formation, chemical sensitization, after completion of the chemical sensitization or the coating liquid preparation of the silver halide emulsion according to the necessity. When the chemical sensitization is carried out in the presence of the compound, the amount of the compound is preferably $1\times10^{-6}$ to $1\times10^{-3}$ moles, more preferably $1\times10^{-5}$ to $5\times10^{-4}$ moles, per mole of silver halide. When the compound is added at the time of completion of chemical sensitization, the amount of the compound is preferably $1\times10^{-6}$ to $1\times10^{-2}$ moles, more preferably $1\times10^{-5}$ to $5\times10^{-3}$ moles, per mole of silver halide. When the compound is added to the silver halide emulsion layer in the course of the coating liquid preparation process, the amount of the compound is preferably $1\times10^{-6}$ to $1\times10^{-1}$ moles, more preferably $1\times10^{-5}$ to $1\times10^{-2}$ moles, per mole of silver halide.

When the compound is added to a layer other than the emulsion layer, the amount of it is preferably $1\times10^{-9}$ to $1\times10^{-3}$ moles per square meter of the layer.

The silver halide emulsion of the present invention may be subjected to a mixture of sensitization method using a gold compound and a sensitization method using a charcogen sensitizer.

As a charcogen sensitizer applicable to the silver halide emulsion of the present invention, a sulfur sensitizer, a selenium sensitizer and a tellurium sensitizer may be used. Of these, a sulfur sensitizer is preferable. As a sulfur sensitizer, a thiosulfate, an arylthiocarbamide thiourea, an arylisothiacyanate, cystine, p-toluenethiosulfonic acid salt, rhodanine and inorganic sulfur are cited.

The added amount of the sulfur sensitizer of the present invention may be changed depending upon the kind of silver halide emulsion applied and the scale of expected effects. It is preferably $5\times10^{-10}$–$5\times10^{-5}$ mol and more preferably $5\times10^{-8}$–$3\times10^{-5}$ mol per mol of silver halide.

A gold sensitizer of the present invention may be added as each gold complex such as chloro aurate and gold sulfide. As a ligand compound used, dimethyl rhodanine, thiocyanate, mercapto tetrazole and mercapto triazole may be cited. The added amount of gold compound is not uniform depending upon the kind of the silver halide emulsion, the kind of compound used and ripening conditions. It is preferably $1\times10^{-4}$–$1\times10^{-8}$ mol and more preferably $1\times10^{5}$–$1\times10^{-8}$ mol per mol of silver halide.

As a chemical sensitization method of the silver halide emulsion of the present invention, a reduction sensitization method may be used.

To the silver halide emulsion used for the present invention, in order to prevent fogging which occurs during preparation process of the silver halide photographic light-sensitive material, to minimize performance fluctuation during storage and to prevent fogging which occurs when a light-sensitive material is developed, a conventional anti-foggant and a stabilizer, other than compounds represented by formulae Z1 and Z2, may be used. As an example of a preferable compound usable for aforesaid purposes, compounds represented by Formula (II) described in Japanese Patent O.P.I. Publication No. 146036/1990, on page 7, at the lower column can be cited. As more preferable compounds, compounds (IIa-1) through (IIa-8) and (IIb-1) through (IIb-7) described in aforesaid invention, on page 8 and compounds such as 1-(3-methoxyphenyl)-5-mercaptotetrazole and 1-(4-ethoxyphenyl)-5-mercapto tetrazole are cited. Depending on their purposes, the above-mentioned compounds may be added in a preparation process, a chemical sensitization process, after aforesaid chemical sensitization process and a coating solution preparation process. When chemical sensitization is conducted in the presence of aforesaid compounds, the amount used is preferably $1\times10^{-5}$–$5\times10^{-4}$ mol per mol of silver halide. When adding them after finish of the chemical sensitization, the amount added is preferably $1\times10^{-6}$–$1\times10^{-2}$ mol and more preferably $1\times10^{-5}$–$5\times10^{-3}$ mol per mol of silver halide. When adding there to the silver halide emulsion layer in the coating solution preparation process, the amount added is preferably $1\times10^{-6}$–$1\times10^{-1}$ mol and more preferably $1\times10^{-5}$–$1\times10^{-2}$ mol per mol of silver halide. When they are added to layers other than the silver halide emulsion layer, the amount of them in the coating layer is preferably $1\times10^{-9}$–$1\times10^{-3}$ mol per 1 $m^2$.

In order to obtain an image having neither reduction in terms of the maximum density nor rise in terms of minimum density and, concurrently with this, to obtain a stable image over time after exposure, even after continuous developing, "generation ratio of developed silver" in the maximum blue density region which occurs due to color developing of the light-sensitive material of the present invention is 85–99% and preferably 90–99% of the silver amount contained in the blue light-sensitive layer. "Generation ratio of developed silver" refers to the ratio of developed silver amount in the blue sensitive layer at the maximum blue density region in a coloring step compared with the silver amount contained in the blue light-sensitive layer contained in the blue light-sensitive layer.

"Generation ratio of developed silver" can be calculated by B/A×100, provided that "B" is the silver amount at the maximum blue density region of a light-sensitive material which was washed and dried after being subjected to color developing and fixing (but not bleaching) and from which any silver halide not contributing to color developing was removed after aforesaid light-sensitive material was subjected to exposure to blue light in such a manner that the light amount was 250 CMS and "A" is a silver amount contained in the blue light-sensitive layer before processing. The silver amount of the light-sensitive material can be measured by a fluorescence X-ray method or an atomic absorption method.

Wave length of maximum sensitivity of the optically sensitized blue sensitive emulsion is preferably 470 nm or less. The sensitivity at 500 nm is preferably half of maximum sensitivity or less.

To the silver halide photographic light-sensitive material used for the present invention, a dye which has absorption on various wavelength region for the purposes of anti-irradiation and anti-halation. For aforesaid purposes, any of various compounds can be used. As a dye having absorption on a visible region, dyes of Formula III described in Japanese Patent O.P.I. Publication No. 281649/1993, dyes AI-1 through 11 described in Japanese Patent O.P.I. Publication 251840/1991, on page 308 and dyes described in Japanese Patent O.P.I. Publication No. 3770/1994 are preferably used. As an infrared absorption dye, compounds represented by Formulas (I), (II) and (III) described in Japanese Patent O.P.I. Publication No. 280750/1989, on page 2, at lower left column have preferable spectral properties. They provide no adverse influence on the photographic properties of the silver halide photographic emulsion and also provide no contamination due to color residue. As practical examples preferred, illustrated compounds (1) through (45) illustrate in aforesaid specification, from page 3, lower left column to 5 page lower left column.

With regard to an amount in which aforesaid dyes are added, if the purpose of to improve sharpness, an amount which causes the spectral reflective density of unprocessed sample at 680 nm is 0.7 or more is preferable, and 0.8 or more is specifically preferable.

It is preferable to add a fluorescent brightening agent in the light-sensitive material of the present invention, since its white background can be improved. As a compound preferably used, compounds represented by Formula II in Japanese Patent O.P.I. Publication No. 232652/1990 are cited.

When a silver halide photographic light-sensitive material of the present invention is used as a color photographic light-sensitive material, it is combined with a yellow coupler, a magenta coupler and a cyan coupler to have layers containing a silver halide emulsion subjected to spectral sensitization on a specific region of 400–900 nm. Aforesaid silver halide emulsion contains one kind of or two or more kind of sensitizing dyes in combination.

As a spectral sensitizing dye used in the silver halide emulsion of the present invention, any of conventional compounds can be used. As a blue sensitive sensitizing dye, compounds represented by Formulas I and II described in Japanese Patent O.P.I. Publication No. 158358/1992 and BS-1 through 8 described in Japanese Patent O.P.I. Publication No. 251840/1991 can be preferably used independently or mixedly in combination. As a green sensitive sensitizing dye, GS-1 through 5 described in Japanese Patent O.P.I. Publication No. 251840/1991, on page 28 are preferably used. As a red sensitive sensitizing dye, compounds represented by Formula IIa described in Japanese Patent O.P.I. Publication No. 216342/1989 and RS-1 through 8 described in Japanese Patent O.P.I. Publication No. 251840/1991 are preferably used. When an image is exposed to infrared beam using a semi-conductor laser, it is necessary to use an infrared sensitive sensitizing dye. As an infrared sensitive sensitizing dye, dyes IRS-1 through 11 described in Japanese Patent O.P.I. Publication No. 285950/1992 are preferably used. It is preferable to mix aforesaid infrared, red, green and blue sensitive sensitizing dyes with super sensitizers SS-1 through SS-9 described in Japanese Patent O.P.I. Publication No. 285950/1992, on pp. 8–9 or compounds S-1 through S-17 described in Japanese Patent O.P.I. Publication No. 66515/1993, on pp. 15–17. In addition, compounds represented by Formulas IV and V described in Japanese Patent O.P.I. Publication No. 216342/1989 are preferable.

Addition timing of aforesaid sensitizing dye may be arbitrary from formation of the silver halide grains to finish of chemical sensitization.

As an addition method of the sensitizing dye, they may be dissolved in water-mixing organic solvent such as methanol, ethanol, alcohol fluoride, acetone and dimethylformamide or water, and added as a solution. Or, they may be added as a solid dispersant.

As a coupler other than the yellow coupler used for the silver halide photographic light-sensitive material of the present invention, those known as a magenta dye forming coupler having a spectral absorption maximum wavelength on wavelength range of 500–600 nm and those known as a cyan dye forming coupler having a spectral absorption maximum wavelength on wavelength region of 600–750 nm.

As a cyan coupler preferably used for the silver halide photographic light-sensitive material of the present invention, couplers represented by Formulas (C-I) and (C-II) described in Japanese Patent O.P.I. Publication No. 114154/1992, on page 5 at lower left column. Practical compounds include CC-1 through CC-9 described in aforesaid specification, from page 5 lower right column to page 6 lower left column.

As a magenta coupler preferably used for the silver halide photographic light-sensitive material of the present invention, couplers represented by Formulas (M-I) and (M-II) described in Japanese Patent O.P.I. Publication No. 114154/1992. Practically, those described in aforesaid specification on page 4, lower left column to page 5 upper right column are cited. Of the above-mentioned magenta couplers, the more preferable ones are couplers represented by Formula (M-I) in aforesaid specification, on page 4, upper right column. Further of these, couplers in which RM of the above-mentioned Formula (M-I) is a tertiary alkyl group is specifically preferable since they are excellent in terms of light fastness. MC-8 through MC-11 described in aforesaid specification, page 5, upper column are excellent in terms of color reproducibility from blue to violet and red, and also excellent in terms of detailed drawing ability.

As a preferable surfactant used for regulating surface tension when photographic additives are dispersed or coated, hydrophobic group having 8 to 30 carbons in one molecule and a sulfonic acid group and their salt. Practically, A-1–A-11 described in Japanese Patent O.P.I. Publication No. 26854/1989 are cited. In addition, surfactants in which a fluorine atom is substituted with an alkyl group are also preferably used. Aforesaid dispersed solution are ordinarily added to a coating solution containing a silver halide emulsion. Time until they are added to the coating solution after being dispersed and time from they are added to the coating solution to coating are the shorter the better. They are respectively within 10 hours. Within 3 hours and within 20 minutes are more preferable.

It is preferable to use an anti-color fading agent in combination with each of the above-mentioned couplers in order to prevent color fading of dye image due to light, heat and humidity. As a preferable compound for a magenta dye use, phenyl-ether-containing compounds represented by Formulas I and II described in Japanese Patent O.P.I. Publication No. 66541/1990, on page 3, phenol-containing compounds represented by Formula IIIB described in Japanese Patent O.P.I. Publication No. 174150/1991, amine-containing compounds represented by Formula A in Japanese Patent O.P.I. Publication No. 90445/1989 and metallic complex represented by Formula XII, XIII, XIV and XV described in Japanese Patent O.P.I. Publication 182741 are preferable. As preferable compounds for a yellow dye and a cyan dye, compounds represented by I' described in Japanese Patent O.P.I. Publication No. 196049/1989, compounds represented by Formula II described in Japanese Patent O.P.I. Publication No. 11417/1993 and compounds represented by Formula I described in Japanese Patent O.P.I. Publication No. 266077/1994 are preferable.

In order to shift absorption wavelength of a coloring dye, a compound (d-11) described in Japanese Patent O.P.I. Publication No. 114154/1992, page 9, on lower left column and compound (A'-1l) described in aforesaid specification, on page 10, on a lower left column can be used. Other than above, fluorescent dye releasing compounds described in U.S. Pat. No. 4,774,187 can be used.

With regard to the silver halide light-sensitive material of the present invention, it is preferable to minimize color stain by adding a compound which reacts with a developing agent oxidized product and adding between a light-sensitive layer and another light-sensitive layer. As a compound used for aforesaid purpose, hydroquinone derivatives are preferable. More preferably, dialkyl hydroquinone such as 2,5-di-t-octyl hydroquinone is preferable. More specifically, compounds represented by Formula II described in Japanese Patent O.P.I. Publication No. 133056/1992 are cited, and compounds II-1 through II-14 described in aforesaid specification, pp. 13–14 and compound 1 described on page 17 are cited.

It is also preferable to add a UV absorber to the light-sensitive material of the present invention, in order to minimize static fogging and improve light-fastness of a dye image. Preferable UV ray absorbers include benzotriazoles. The specifically preferable compounds include compounds represented by Formula III-3 in Japanese Patent O.P.I. Publication No. 250944/1989, compounds represented by Formula III described in Japanese Patent O.P.I. Publication No. 66646/1989, UV-1L–UV-27L described in Japanese Patent O.P.I. Publication No. 187240/1988, compounds represented by Formula I described in Japanese Patent O.P.I. Publication No. 1633/1992 and compounds represented by Formulas (I) and (II) described in Japanese Patent O.P.I. Publication No. 165144/1993 are cited.

It is advantageous to use gelatin as a binder in the silver halide photographic light-sensitive material. As necessary, other gelatins, gelatin derivatives, graft polymer between gelatin and another polymer, protein other than gelatin, sugar derivatives, cellulose derivatives and hydrophilic colloid such as synthetic hydrophilic polymer such as a monomer or a copolymer may be used.

As a hardener for the above-mentioned binders, it is preferable to use a vinyl sulfonic type hardener and a chlorotriazine type hardener independently or two or more thereof may be used in combination. It is preferable to use compounds described in Japanese Patent O.P.I. Publication Nos. 249054/1986 and 245153/1986. In order to prevent propagation of mildews and bacteria which adversely influence photographic performance and image storage stability, it is preferable to incorporate anti-mildew agent and an antiseptics as described in Japanese Patent O.P.I. Publication No. 157646/1992. In addition, in order to improve a light-sensitive material or physical properties on the surface of a sample after being processed, it is preferable to add a lubricant or a matting agent as described in Japanese Patent O.P.I. Publication Nos. 118543/1994 and 73250/1990 in a protective layer.

As a support used for the silver halide photographic light-sensitive material of the present invention, any materials can be used. Paper laminated with polyethylene and polyethylene terephthalate, paper support comprises natural pulp or synthetic pulp, a vinyl chloride sheet, propyrene which may contain a white pigment, polyethylene terephthalate support and a baryta paper can be used. Of these, a support having a water-proof resin laminated layer on both base paper is preferable. As a water-proof resin, polyethylene, polyethylene terephthalate or its copolymer are preferable.

As a white pigment used for a support, an inorganic and/or organic white pigment may be used. The preferable is an inorganic white pigment. For example, sulfates of an alkaline earth metal such as barium sulfate, carbonate of an alkaline earth metal such as calcium carbonate, silicas such as fine powder silicate and synthetic silicate salt, calcium silicate, alumna, alumna hydrate, titanium oxide, zinc oxide, talc and cray are used. The white pigment is preferably barium sulfate and titanium oxide.

The amount of white pigment contained in a water-proof resin layer on the surface of a support is preferably 13 wt% or more and more preferably 15 wt% or more, from viewpoint of improving sharpness.

The degree of dispersion of the white pigment in a water-proof resin layer in paper support of the present invention can be measured by a method described in Japanese Patent O.P.I. Publication No. 28640/1990. When measured by means of aforesaid method, the degree of dispersion of white pigment is preferably 0.20 or less and more preferably 0.15 or less in terms of fluctuation coefficient described in aforesaid specification.

If the average coarseness on the central plane of a support is 0.15 μm or less and further 0.12 μm or less, it is preferable since effect that glossiness is favorable can be obtained. In addition, in order to regulate spectral reflective density balance on the white background after being processed and to improve white background, it is preferable to add minute amount of blue-tinting agent or red-tinting agent such as ultramarine blue or an oil-soluble dye in a white pigment containing water-proof resin in the reflective support or in a hydrophilic colloidal layer coated.

The silver halide photographic light-sensitive material of the present invention is coated on a support subjected to corona discharge, UV ray irradiation and flame processing as necessary. Following these, coating solutions may be coated directly or through a subbing layer (one or two or more subbing layer for improving properties such as adhesiveness of a support surface, anti-static property, dimension stability, anti-friction property, hardness, anti-halation property, friction properties and/or other properties).

When coating a photographic light-sensitive material employing a silver halide emulsion, an viscosity-increasing agent may be used for improving coating properties. As a coating method, an extrusion coating method and a curtain coating method are specifically useful which can coat two or more kind of layers concurrently.

In order to form a photographic image using the silver halide photographic light-sensitive material of the present invention, an image recorded on the negative film may be optically image-formed on the silver halide photographic light-sensitive material to be printed. Aforesaid image may be temporarily converted to digital information and the resulting image may be image-formed on a CRT (cathode ray tube), and then, aforesaid image may be image-formed on the silver halide photographic light-sensitive material to be printed. Or, an image may be printed by scanning while the strength of the laser beam is changed based on digital information.

It is preferable that the present invention may be applied to a light-sensitive material in which a developing agent is not built-in the light-sensitive material and that the present invention is applied to a light-sensitive material forming an image for direct appreciation specifically. For example, it is applicable to color paper, color reversal paper, light-sensitive materials forming a positive image, light-sensitive materials for display use and light-sensitive materials for color proof use. Specifically, it is preferable to apply to light-sensitive materials having a reflective support.

As an aromatic group primary amine developing agent used in the present invention, conventional compounds may be used. As examples of aforesaid compounds, the following compounds may be illustrated:

CD-1) N,N-diethyl-p-phenylenediamine
CD-2) 2-amino-5-diethylamino toluene
CD-3) 2-amino-5-(N-ethyl-N-laurylamino)toluene
CD-4) 4-(N-ethyl-N-(β-hydroxyethyl)amino)aniline
CD-5) 2-methyl-4-(N-ethyl-N-(β-hydroxyethyl) amino) aniline
CD-6) 4-amino-3-methyl-N-ethyl-N-(β-(methansulfonamide) ethyl)aniline
CD-7) N-(2-amino-5-diethylaminophenylethyl) methanesulfonamide
CD-8) N, N-dimethyl-p-phenylenediamine
CD-9) 4-amino-3-methyl-N-ethyl-N-methoxyethylaniline
CD-10) 4-amino-3-methyl-N-ethyl-N-(β-ethoxyethyl) aniline
CD-11) 4-amino-3-methyl-N-ethyl-N-(γ-hydroxypropyl) aniline The above-mentioned color developing solution may be used at an arbitrary pH region. However, from viewpoint of rapid processability, it is preferable that pH is 9.5 to 13.0, and it is more preferable that pH is 9.8 to 12.0.

The processing temperature of color developing of the present invention is 35° C. or more and 70° C. or less. The higher the temperature is, the shorter the processing time is. However, if the temperature is too high, stability of the processing solution is not acceptable. It is preferable to process at 37° C. or higher and 60° C. or lower.

Color developing time is conventionally 3 minutes and 30 seconds. In the present invention, less than 40 seconds is preferable, and within 25 seconds is more preferable.

To a color developing solution, conventional developing solution component compounds may be added in addition to the above-mentioned color developing agent. Ordinarily, development inhibitors such as an alkaline agent having pH buffer effect, chlorine ion and benzotrizole, preserver and a chelating agent are used.

The silver halide photographic light-sensitive material of the present invention may be subjected to bleaching process and fixing process after color developing. The bleaching process may be conducted concurrently with the fixing process. After fixing process, it is ordinary that washing process is applied. In place of the washing process, stabilizing process may be applied. As a developing apparatus used for developing the silver halide photographic light-sensitive material of the present invention, a roller transportation type in which a light-sensitive material is sandwiched by rollers provided in the processing tank to be conveyed or an endless belt type in which the light-sensitive material is fixed on a belt. In addition, a system in which the processing tank is formed in a slip shaped and the light-sensitive material is conveyed together with feeding the processing solution onto aforesaid processing tank, a spray type in which a processing solution is sprayed, a web type in which a carrier immersed in the processing solution is contacted and a type using a viscosity processing solution. When a light-sensitive material is processed in a large amount, it is ordinary to conduct running processing using an automatic developing machine. In this occasion, the replenishment amount of the replenisher solution is smaller, the preferable. The most preferable processing style from viewpoint of environment friendliness is to add a replenishing solution in a form of replenishing tablet. A method disclosed in Published Technical Report No. 16935/1994 is the most preferable.

EXAMPLE

The present invention will be explained referring to examples.

Example 1

On both sides of paper pulp whose weight was 180 g/m$^2$, high density polyethylene was laminated so that a paper support was prepared. On a side in which an emulsion layer was coated, molten polyethylene containing anatase type titanium oxide in which its surface has been processed was dispersed in the content of 15 wt % so that a reflective support was prepared. This reflective support was subjected to corona discharge, and then a gelatin subbing layer was prepared. The coating solution was prepared in the following manner. Coating solution for the first layer To 23.4 g of a yellow coupler (Y-1), 3.34 g of dye image stabilizer (ST-1), 1.67 g of (ST-2), 3.34 g of (ST-5), 0.34 g of anti-stain agent (HQ-4) and 4.98 g of a high boiling organic solvent (DNP), 60 ml of ethyl acetic acid was added to be dissolved. Using a ultrasonic homogenizer, the above-mentioned solution was emulsified and dispersed in a 10% aqueous gelatin solution containing 7 ml of a 20% surfactant (SU-1) so that a yellow coupler dispersed solution was prepared. This dispersed solution was mixed with a blue sensitive silver halide emulsion prepared under the following conditions so that a coating solution for the first layer was prepared.

The coating solutions for the second layer through 7th layer were also prepared in the same manner as in the coating solution for the first layer having an amount as shown in Tables 1 and 2.

As a hardener, (H-1) and (H-2) were added. As a coating aid, surfactants (SU-2) and (SU-3) were added for regulating surface tension. In each layer, F-1 was added in a manner that the total amount thereof would be 0.04 g/m$^2$.

TABLE 1

| Layer | Constitution | Added amount (g/m$^2$) |
|---|---|---|
| 7th layer (Protective layer) | Gelatin | 1.00 |
| | DIDP | 0.002 |
| | DBP | 0.002 |
| | Anti-stain agent (HQ-7) | 0.002 |
| | Anti-stain agent (HQ-8) | 0.002 |
| | Anti-stain agent (HQ-9) | 0.004 |
| | Anti-stain agent (HQ-19) | 0.02 |
| | Compound B, C, D and E | Respectively $2 \times 10^{-5}$ |
| | Anti-mildew agent (F-1) | 0.002 |
| | Silicone dioxide | 0.003 |
| 6th layer (UV ray absorption layer) | Gelatin | 0.40 |
| | AL-1 | 0.01 |
| | UV absorber (UV-1) | 0.12 |
| | UV absorber (UV-2) | 0.04 |
| | UV absorber (UV-3) | 0.16 |
| | Anti-stain agent (HQ-19) | 0.04 |
| | Compound F and G | Respectively $2 \times 10^{-4}$ |
| | PVP | 0.03 |
| 5th layer (red sensitive layer) | Gelatin | 1.30 |
| | Red sensitive silver bromochloride emulsion (Em-R) | 0.21 |
| | Cyan coupler (C-1) | 0.25 |
| | Cyan coupler (C-2) | 0.08 |
| | Dye image stabilizer (ST-1) | 0.10 |
| | Anti-stain agent (HQ-4) | 0.004 |
| | DBP | 0.10 |
| | DOP | 0.20 |
| 4th layer (UV ray absorption layer) | Gelatin | 0.94 |
| | UV absorber (UV-1) | 0.28 |
| | UV absorber (UV-2) | 0.09 |
| | UV absorber (UV-3) | 0.38 |
| | AL-1 | 0.02 |

TABLE 1-continued

| Layer | Constitution | Added amount (g/m$^2$) |
|---|---|---|
| | Anti-stain agent (HQ-19) | 0.10 |
| | Compound F and G | Respectively $4 \times 10^{-4}$ |

TABLE 2

| Layer | Constitution | Added amount (g/m$^2$) |
|---|---|---|
| 3rd layer (green sensitive layer) | Gelatin | 1.30 |
| | AI-2 | 0.01 |
| | Green sensitive silver bromochloride emulsion (Em-G) | 0.14 |
| | Magenta coupler (M-1) | 0.20 |
| | Dye image stabilizer (ST-3) | 0.20 |
| | Dye image stabilizer (ST-4) | 0.17 |
| | DIDP | 0.13 |
| | DBP | 0.13 |
| 2nd layer (intermediate layer) | Gelatin | 1.20 |
| | AI-3 | 0.01 |
| | Anti-stain agent (HQ-7) | 0.03 |
| | Anti-stain agent (HQ-8) | 0.03 |
| | Anti-stain agent (HQ-9) | 0.05 |
| | Anti-stain agent (HQ-19) | 0.23 |
| | DIDP | 0.04 |
| | DBP | 0.02 |
| | Fluorescent brightening agent (W-1) | 0.10 |
| 1st layer (blue sensitive layer) | Gelatin | 1.20 |
| | Blue sensitive silver bromochloride emulsion (Em-B) | 0.26 |
| | Yellow coupler (Y-1) | 0.70 |
| | Dye image stabilizer (ST-1) | 0.10 |
| | Dye image stabilizer (ST-2) | 0.10 |
| | Image stabilizer A | 0.15 |
| | Anti-stain agent (HQ-4) | 0.01 |
| | DNP | 0.15 |
| Support | Polyethylene laminated paper (containing fine amount of coloring agent) | |

Added amount of silver halide emulsion was represented in conversion to silver.

SU-1: Sodium tri-i-propyl naphthalene sulfonic acid

SU-2: Sodium salt of sulfosuccinic acid di(2-ethylhexyl

SU-3: Sodium salt of sulfosuccinic acid di(2,2,3,3,4,4,5,5,-octafluoropentyl

DBP: Dibutylphthalate

DNP: Dinonylphthalate

DOP: Dioctylphthalate

DIDP: Di-i-decylphthalate

PVP: Polyvinylpyrrolidone

H-1: Tetrakis(vinylsulfonylmethyl)methane

H-2: Sodium 2,4-dichloro-6-hydroxy-s-triazine

HQ-4: 2,5-di-t-octyl hydroquinone

HQ-7: 2,5-di-sec-dodecyl hydroquinone

HQ-8: 2,5-di-sec-tetradecyl hydroquinone

HQ-9: 2-sec-dodecyl-5-sec-tetradecyl hydroquinone

HQ-19: 2,5-di(1,1-dimethyl-4-hexyloxycarbonyl)butyl hydroquinone

Image stabilizer A: p-t-octylphenol

Compounds C, D and E: respectively quinones of HQ-7, 8, 9 and 19

Compound F
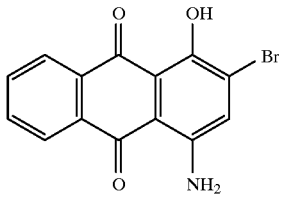
Compound 4 discribed in Japanese Patent O.P.I. Publication No. 842/1990
Compound G
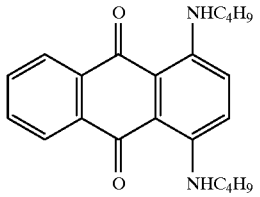
Compound 9 discribed in Japanese Patent O.P.I. Publication No. 842/1990
M-1
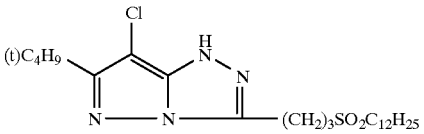
MC-8 discribed in Japanese Patent O.P.I. Publication No. 114154/1992
C-1
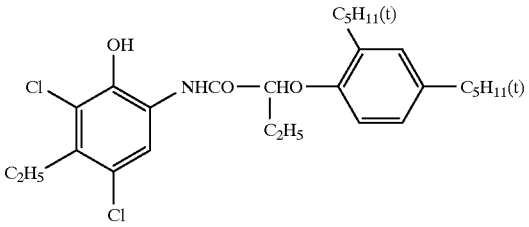
II-4 discribed in Japanese Patent O.P.I. Publication No. 251845/1990
C-2
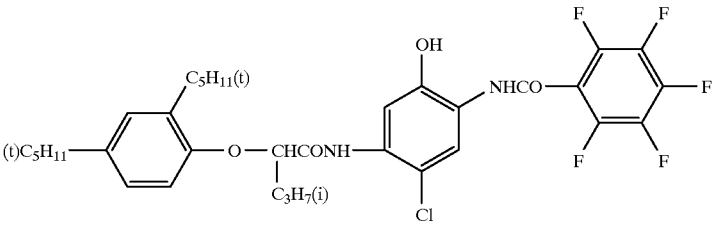
I-2 discribed in Japanese Patent O.P.I. Publication No. 251845/1990
Y-1 (Comp.)
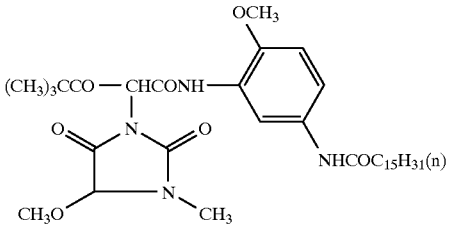

-continued
ST-1
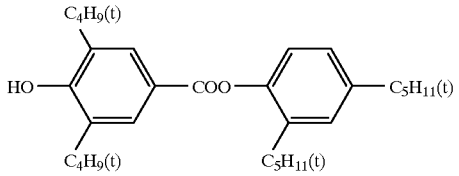
I-13 discribed in Japanese Patent O.P.I. Publication No. 196049/1989
ST-2
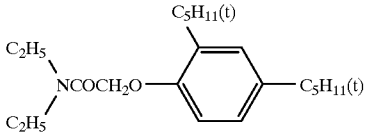
ST-3
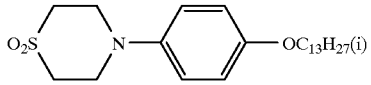
A-3 discribed in Japanese Patent O.P.I. Publication No. 90445/1989
ST-4
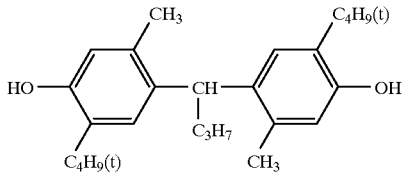
III-4 discribed in Japenese Patent O.P.I. Publication No. 174150/1991
ST-5
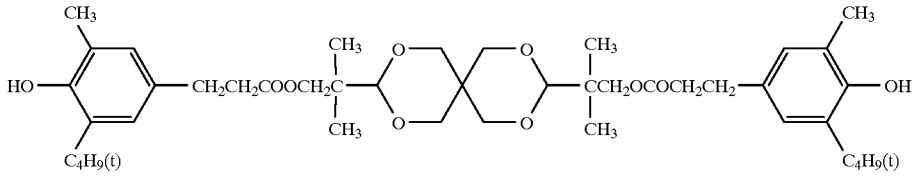
1-19 discribed in Japanese Patent O.P.I. Publication No. 266077/1994
UV-1
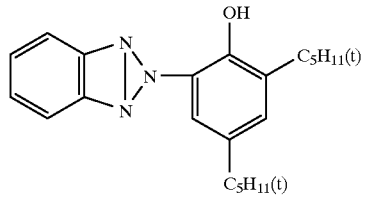
IIIc-1 discribed in Japanese Patent O.P.I. Publication No. 2590944/1989

-continued
UV-2
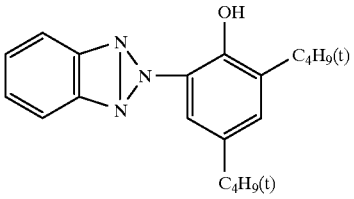
IIIc-7 discribed in Japanese Patent
O.P.I. Publication No. 2590944/1989
UV-3
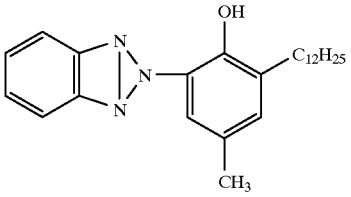
UV-23L discribed in Japanese Patent
O.P.I. Publication No. 187240/1988
AI-1
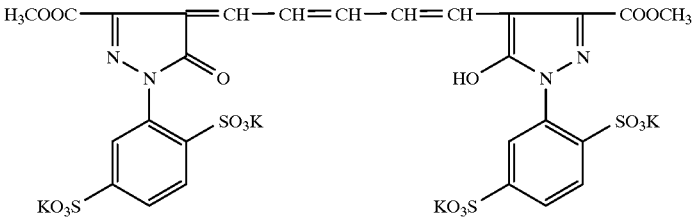
Compound represented by Japanese Patent
O.P.I. Publication No. 281649/1993
AI-2
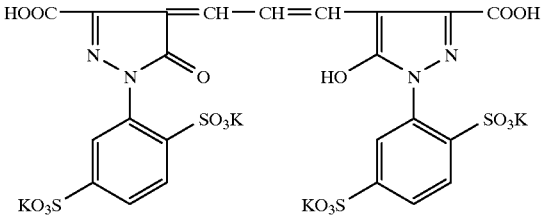
AI-3
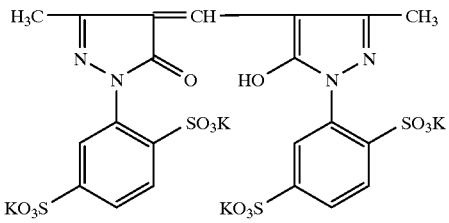
W-1
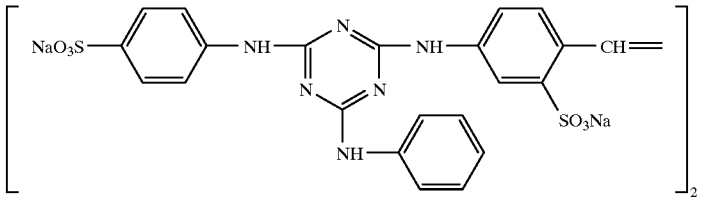
No. 3 discribed in Japanese Patent
O.P.I. Publication No. 232652/1990

-continued

F-1

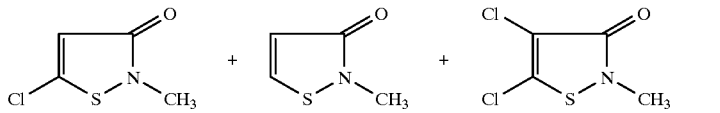

(50%) (46%) (4%) mol ratio

No. 9 discribed in Japanese Patent O.P.I. Publication No. 157646/1991

(Preparation of blue sensitive silver halide emulsion)

In 1 liter of an aqueous 2% gelatin solution kept at 40° C., the following solutions A and B were simultaneously added spending 30 minutes while pAg was regulated to 7.3 and pH was regulated to 3.0. In addition, the following solutions C and D were simultaneously added spending 180 minutes while pAg was regulated to 8.0 and pH was regulated to 5.0. In this occasion, pAg was regulated by a method described in Japanese Patent O.P.I. Publication No. 45437/1984, and pH was regulated using sulfuric acid or an aqueous sodium hydroxide solution.

(Solution A)

| | |
|---|---|
| Sodium chloride | 3.42 g |
| Potassium bromide | 0.03 g |

(Solution B)

| | |
|---|---|
| Silver nitrate | 10 g |

(Solution C)

| | |
|---|---|
| Sodium chloride | 102.7 g |
| $K_2IrCl_6$ | $4 \times 10^{-8}$ mol/mol Ag |
| $K_4Fe(CN)_6$ | $2 \times 10^{-5}$ mol/mol Ag |
| Potassium bromide | 1.0 g |

(Solution D)

| | |
|---|---|
| Silver nitrate | 300 g |

After finish of addition, the resulting solution was subjected to desalting using an aqueous 5% Demol N produced by Kao Atlas and an aqueous 20% magnesium sulfate solution. Following this, the resulting solution was mixed with an aqueous gelatin solution so that a mono-dispersed cubic emulsion EMP-1 wherein the average grain size was 0.71 μm, the fluctuation coefficient of grain distribution was 0.07 and silver chloride content was 99.5 mol % was obtained. Next, a mono-dispersed cubic emulsion EMP-1B was obtained wherein the average grain size was 0.64 μm, the fluctuation coefficient of grain size distribution was 0.07 and silver chloride content was 99.5 mol % was obtained in the same manner as in EMP-1 except the addition time of Solutions A and B and that of Solutions C and D were changed.

The above-mentioned EMP-1 was subjected to the most suitable chemical sensitization at 60° C. using the following compound. EMP-1B was also subjected to the most suitable chemical sensitization at 60° C. Following this, the sensitized EMP-1 and EMP-1B was mixed at a ratio of 1:1 to obtain a blue sensitive silver halide emulsion (Em-B) was obtained.

| | |
|---|---|
| Sodium thiosulfate | 0.8 mg/mol of AgX |
| Chloro aurate | 0.5 mg/mol of AgX |
| Stabilizer STAB-1 | $3 \times 10^{-4}$ mol/mol of AgX |
| Stabilizer STAB-2 | $3 \times 10^{-4}$ mol/mol of AgX |
| Stabilizer STAB-3 | $3 \times 10^{-4}$ mol/mol of AgX |
| Sensitizing dye BS-1 | $4 \times 10^{-4}$ mol/mol of AgX |
| Sensitizing dye BS-2 | $1 \times 10^{-4}$ mol/mol of AgX |

(Preparation of green sensitive silver halide emulsion)

Next, a mono-dispersed cubic emulsion EMP-2 was obtained wherein the average grain size was 0.40 μm, the fluctuation coefficient of grain size distribution was 0.08 and silver chloride content was 99.5 mol % was obtained in the same manner as in EMP-1 except the addition time of Solutions A and B and that of Solutions C and D were changed. Next, a mono-dispersed cubic emulsion EMP-2B was obtained wherein the average grain size was 0.50 μm, the fluctuation coefficient of grain size distribution was 0.08 and silver chloride content was 99.5 mol % was obtained in the same manner as in EMP-1.

The above-mentioned EMP-2 was subjected to the most suitable chemical sensitization at 55° C. using the following compound. EMP-2B was also subjected to the most suitable chemical sensitization. Following this, the sensitized EMP-2 and EMP-2B was mixed at a ratio of 1:1 to obtain a green sensitive silver halide emulsion (Em-G) was obtained.

| | |
|---|---|
| Sodium thiosulfate | 1.5 mg/mol of AgX |
| Chloro aurate | 1.0 mg/mol of AgX |
| Stabilizer STAB-1 | $3 \times 10^{-4}$ mol/mol of AgX |
| Stabilizer STAB-2 | $3 \times 10^{-4}$ mol/mol of AgX |
| Stabilizer STAB-3 | $3 \times 10^{-4}$ mol/mol of AgX |
| Sensitizing dye GS-1 | $4 \times 10^{-4}$ mol/mol of AgX |

(Preparation of red sensitive silver halide emulsion)

Next, a mono-dispersed cubic emulsion EMP-3 was obtained wherein the average grain size was 0.40 μm, the fluctuation coefficient of grain size distribution was 0.08 and silver chloride content was 99.5 mol % was obtained in the same manner as in EMP-1 except the addition time of Solutions A and B and that of Solutions C and D were changed. Next, a mono-dispersed cubic emulsion EMP-2B was obtained wherein the average grain size was 0.38 μm, the fluctuation coefficient of grain size distribution was 0.08 and silver chloride content was 99.5 mol % was obtained in the same manner as in EMP-3B.

The above-mentioned EMP-3 was subjected to the most suitable chemical sensitization at 60° C. using the following compound. EMP-3B was also subjected to the most suitable chemical sensitization. Following this, the sensitized EMP-3 and EMP-3B was mixed at a ratio of 1:1 to obtain a green sensitive silver halide emulsion (Em-R) was obtained.

| | |
|---|---|
| Sodium thiosulfate | 1.8 mg/mol of AgX |
| Chloro aurate | 2.0 mg/mol of AgX |
| Stabilizer STAB-1 | $3 \times 10^{-4}$ mol/mol of AgX |
| Stabilizer STAB-2 | $3 \times 10^{-4}$ mol/mol of AgX |
| Stabilizer STAB-3 | $3 \times 10^{-4}$ mol/mol of AgX |
| Sensitizing dye RS-1 | $1 \times 10^{-4}$ mol/mol of AgX |
| Sensitizing dye RS-1 | $1 \times 10^{-4}$ mol/mol of AgX |

STAB-1: 1-(3-acetoamidephenyl)-5-mercaptotetrazole
STAB-2: 1-phenyl-5-mercapto tetrazole
STAB-3: 1-(4-ethoxyphenyl)-5-mercapto tetrazole In addition, SS-1 was added to the red sensitive emulsion by $2.0 \times 10^{-3}$ per mol of silver halide.

BS-1

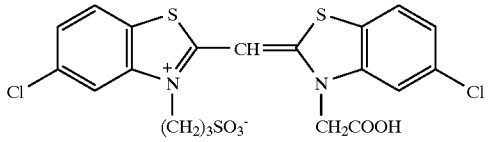

II-8 discribed in Japanese Patent O.P.I. Publication No. 158358/1992

BS-2

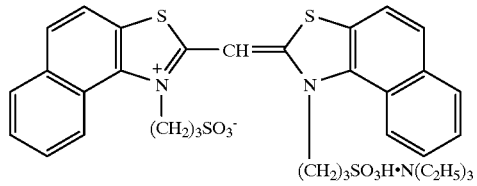

I-9 discribed in Japanese Patent O.P.I. Publication No. 158358/1992

GS-1

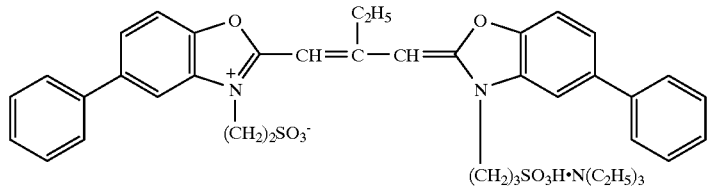

GS-1 discribed in Japanese Patent O.P.I. Publication No. 251840/1991

RS-1

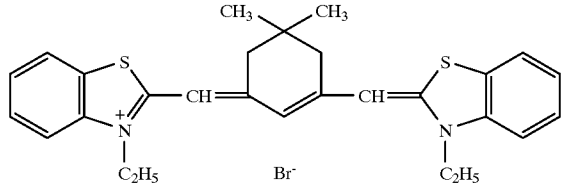

D-1 discribed in Japanese Patent O.P.I. Publication No. 251840/1991

-continued

RS-2

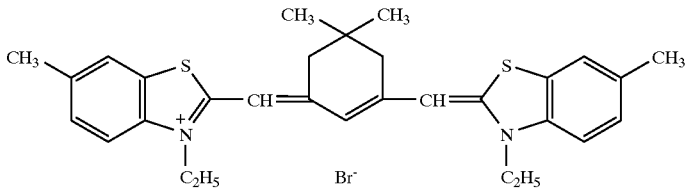

II-3 discribed in Japanese Patent O.P.I. Publication No. 148783/1994

SS-1

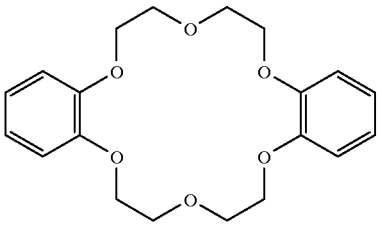

S-19 discribed in Japanese Patent O.P.I. Publication No. 148783/1994

A sample prepared in the above-mentioned manner was defined to be Sample 101. Then, Samples 102 through 123 were prepared in the same manner as in Sample 101 except that the yellow coupler in the 1st layer and its amount (mol/m$^2$) were changed as shown in Table 4 below and 4.68 g of polymer compound P-4 were respectively added to the solvent of the yellow coupler to be dispersed, shown in table 4 below. In addition, Samples 124, 125, 126 and 127 were prepared from Sample 122 except the added amount of HQ-4 (0.34 g (namely, HQ-4 was contained 2.5 mol% per the yellow coupler) was changed to 0.08 g, 0.15 g, 0.58 g and 0.76 g respectively (namely, HQ-4 was respectively contained by 0.6, 1.1, 4.3 and 5.6 mol %). In addition, a Sample prepared in the same manner as in Sample 122 except that HQ-9, in place of HQ-4, was added by 0.34 g was defined to be Sample No. 128. Number average molecular weight of P-4 is 12,000.

Samples used in the above-mentioned manner were subjected to wedge exposure to light by means of a conventional method. Following this, each sample was subjected to developing process under the following developing steps.

| Processing Steps | Processing Time | Time | Replenishing Amount |
|---|---|---|---|
| Color Developing | 38.0 ± 0.3° C. | 18 sec. | 60 cc |
| Bleach Fixing | 35.0 ± 0.5° C. | 22 sec. | 80 cc |
| Stabilizing | 30–40° C. | 40 sec. | 120 cc |
| Drying | 60–80° C. | 30 sec. | |

Composition of the developing solution will be illustrated as below:

Color developing tank solution and replenishing solution

| | Tank solution | Replenishing solution |
|---|---|---|
| Pure water | 800 ml | 800 ml |
| Triethylene glycol | 2 g | 3 g |
| Diethylene glycol | 10 g | 10 g |
| Potassium bromide | 0.01 g | — |
| Potassium chloride | 4.5 g | — |
| Potassium sulfite | 0.25 g | 0.5 g |
| N-ethyl-N-(βmethanesulfonamide ethyl)-3-methyl-4-aminoaniline sulfate | 5.0 g | 8.0 g |
| N,N-diethyhydroxylamine | 5.5 g | 7.0 g |
| Triethanolamine | 10.0 g | 10.0 g |
| Sodium salt of diethylenetriamine pentaacetic acid | 2.0 g | 2.0 g |
| Fluorescent brightening agent (4,4'-diaminostylbene disulfonic acid derivative) | 2.0 g | 2.5 g |
| Potassium carbonate | 30 g | 30 g |

Water was added to make 1 liter in total. Tank solution was regulated to 10.60, and the replenishing solution-was regulated to 11.00.

Bleach fixing solution and its replenishing solution

| | |
|---|---|
| Ferric ammonium dihydride of diethylenetriamine pentaacetic acid | 75 g |
| Diethylenetriamine pentaacetic acid | 3.5 g |
| Ammonium thiosulfate (an aqueous 70% solution) | 150 ml |
| 2-amino-5-mercapto-1,3,4-thiadiazole | 2.0 g |
| Ammonium sulfite (an aqueous 40% solution) | 33.5 ml |

Water was added to make 1 liter in total, and pH was regulated to 5.0 using potassium carbonate or glacial acetic acid.

Stabilizing solution and its replenishing solution

| | |
|---|---|
| o-phenylphenol | 1.0 g |
| 5-chloro-2-methyl-4-isothiazoline-3-on | 0.02 g |
| 2-methyl-4-isothiazoline-3-on | 0.02 g |

-continued

| | |
|---|---|
| 2-methyl-4-isothiazoline-3-on | 0.02 g |
| Diethylene glycol | 1.0 g |
| Fluorescent brightening agent (Chinopal SFP) | 2.0 g |
| 1-hydroxyethilidene-1,1-disulfonic acid | 1.8 g |
| Bismuth chloride (an aqueous 45% solution) | 0.65 g |
| Magnesium sulfate · heptahydride | 0.2 g |
| PVP | 1.0 g |
| Aqueous ammonia (an aqueous 25% ammonium hydroxide solution) | 2.5 g |
| Trisodium salt of nitrilo triacetic acid | 1.5 g |

In the color developing process, the above-mentioned process is called A. Processes B, C and D wherein the added amount of N-ethyl-N-(β-methanesulfonamideethyl)-3-methyl-4-aminoaniline sulfate in the color developing solution tank solution and the color developing processing temperature were changed as shown in Tables B, C and D.

TABLE 3

| | Amount of CD-12/1 liter | | Temperature of |
|---|---|---|---|
| | Tank solution (g) | Replenisher (g) | color developing solution |
| Process A | 5.0 | 8.0 | 38.0 ± 0.3 |
| Process B | 8.0 | 11.0 | 38.0 ± 0.3 |
| Process C | 5.0 | 8.0 | 42.0 ± 0.3 |
| Process D | 8.0 | 11.0 | 42.0 ± 0.3 |

The coloring properties (the maximum coloring density) of the resulting coloring samples and coloring fogging were measured by the following method.

<Coloring properties>

Maximum coloring density (Dmax) of the blue light-sensitive emulsion layer of each of processed sample using a densitometer Model PDA-65 (produced by Konica) was measured.

<Coloring fogging>

Unexposed each sample was subjected to the above-mentioned processing. Using 310 TR produced by X-rite, reflective density was measured.

Table 4 shows the results thereof.

TABLE 4

| | 1st layer | | | $D_{max}$ | | | | Fog | | | |
|---|---|---|---|---|---|---|---|---|---|---|---|
| Sample No. | Yellow Coupler | (m mol/m$^2$) | Polymer | Process A | Process B | Process C | Process D | Process A | Process B | Process C | Process D |
| 101 | Y-1 | 1.05 | — | 2.06 | 2.19 | 2.21 | 2.30 | 0.017 | 0.020 | 0.019 | 0.026 |
| 102 | Y-1 | 0.88 | — | 1.98 | 2.11 | 2.14 | 2.23 | 0.016 | 0.020 | 0.018 | 0.025 |
| 103 | Y-1 | 1.21 | — | 2.13 | 2.26 | 2.28 | 2.35 | 0.018 | 0.024 | 0.022 | 0.030 |
| 104 | Y-3 | 0.88 | — | 1.80 | 2.00 | 2.01 | 2.18 | 0.018 | 0.022 | 0.020 | 0.026 |
| 105 | Y-3 | 1.05 | — | 1.93 | 2.09 | 2.10 | 2.25 | 0.019 | 0.023 | 0.021 | 0.028 |
| 106 | Y-3 | 1.21 | — | 1.99 | 2.16 | 2.18 | 2.31 | 0.020 | 0.026 | 0.024 | 0.033 |
| 107 | Y-2 | 1.05 | — | 1.98 | 2.12 | 2.13 | 2.27 | 0.016 | 0.020 | 0.018 | 0.026 |
| 108 | Y-4 | 1.05 | — | 1.72 | 1.95 | 1.98 | 2.18 | 0.017 | 0.021 | 0.019 | 0.029 |
| 109 | I-5 | 1.05 | — | 2.11 | 2.24 | 2.27 | 2.37 | 0.019 | 0.024 | 0.023 | 0.029 |
| 109a | I-9 | 1.05 | — | 2.09 | 2.21 | 2.25 | 2.36 | 0.018 | 0.022 | 0.023 | 0.028 |
| 109b | I-14 | 1.05 | — | 2.14 | 2.24 | 2.28 | 2.39 | 0.020 | 0.025 | 0.025 | 0.031 |
| 110 | I-15 | 1.05 | — | 2.13 | 2.24 | 2.28 | 2.39 | 0.018 | 0.023 | 0.023 | 0.028 |
| 110a | I-18 | 1.05 | — | 2.10 | 2.22 | 2.26 | 2.33 | 0.018 | 0.022 | 0.021 | 0.027 |
| 111 | Y-1 | 0.88 | P-2 | 1.92 | 2.07 | 2.11 | 2.20 | 0.016 | 0.019 | 0.017 | 0.024 |
| 112 | Y-1 | 1.05 | P-2 | 2.03 | 2.19 | 2.20 | 2.28 | 0.017 | 0.019 | 0.018 | 0.025 |
| 113 | Y-1 | 1.21 | P-2 | 2.11 | 2.26 | 2.27 | 2.33 | 0.018 | 0.023 | 0.021 | 0.029 |
| 114 | Y-2 | 0.88 | P-2 | 1.88 | 2.03 | 2.04 | 2.20 | 0.015 | 0.018 | 0.018 | 0.024 |
| 115 | Y-2 | 1.05 | P-2 | 1.94 | 2.09 | 2.09 | 2.24 | 0.016 | 0.020 | 0.019 | 0.025 |
| 116 | Y-2 | 1.21 | P-2 | 2.05 | 2.16 | 2.17 | 2.31 | 0.018 | 0.022 | 0.021 | 0.027 |
| 117 | Y-3 | 1.05 | P-2 | 1.95 | 2.12 | 2.14 | 2.29 | 0.019 | 0.023 | 0.022 | 0.027 |
| 118 | Y-4 | 1.21 | P-2 | 1.81 | 2.07 | 2.09 | 2.28 | 0.020 | 0.024 | 0.024 | 0..031 |
| 119 | I-5 | 0.88 | P-2 | 2.21 | 2.27 | 2.28 | 2.34 | 0.017 | 0.019 | 0.018 | 0.021 |
| 119a | I-5 | 1.12 | P-2 | 2.24 | 2.29 | 3.31 | 2.36 | 0.019 | 0.020 | 0.022 | 0.025 |
| 119b | I-5 | 0.76 | P-2 | 2.21 | 2.27 | 2.27 | 2.32 | 0.016 | 0.018 | 0.018 | 0.020 |
| 119c | I-5 | 0.65 | P-2 | 2.20 | 2.25 | 2.27 | 2.30 | 0.016 | 0.017 | 0.017 | 0.019 |
| 119d | I-9 | 1.12 | P-2 | 2.24 | 2.30 | 2.32 | 2.37 | 0.020 | 0.022 | 0.023 | 0.026 |
| 119e | I-9 | 0.88 | P-2 | 2.23 | 2.27 | 2.28 | 2.34 | 0.019 | 0.020 | 0.021 | 0.023 |
| 119f | I-9 | 0.76 | P-2 | 2.22 | 2.25 | 2.28 | 2.33 | 0.017 | 0.018 | 0.019 | 0.021 |
| 119g | I-9 | 0.65 | P-2 | 2.19 | 2.23 | 2.26 | 2.30 | 0.016 | 0.018 | 0.019 | 0.020 |
| 119h | I-14 | 1.12 | P-2 | 2.26 | 2.33 | 2.36 | 2.42 | 0.019 | 0.021 | 0.021 | 0.024 |
| 119i | I-14 | 0.88 | P-2 | 2.24 | 2.31 | 2.34 | 2.37 | 0.017 | 0.019 | 0.020 | 0.021 |
| 119j | I-14 | 0.76 | P-2 | 2.23 | 2.29 | 2.32 | 2.34 | 0.016 | 0.018 | 0.019 | 0.021 |
| 119k | I-14 | 0.65 | P-2 | 2.21 | 2.26 | 2.28 | 2.31 | 0.015 | 0.016 | 0.017 | 0.019 |
| 120 | I-15 | 1.12 | P-2 | 2.29 | 2.35 | 2.37 | 2.41 | 0.018 | 0.020 | 0.021 | 0.024 |
| 121 | I-15 | 0.88 | P-2 | 2.26 | 2.32 | 2.34 | 2.37 | 0.016 | 0.018 | 0.019 | 0.021 |
| 122 | I-15 | 0.76 | P-2 | 2.26 | 2.31 | 2.33 | 2.35 | 0.016 | 0.018 | 0.018 | 0.020 |
| 123 | I-15 | 0.65 | P-2 | 2.22 | 2.28 | 2.29 | 2.31 | 0.014 | 0.016 | 0.017 | 0.019 |
| 123a | I-18 | 1.12 | P-2 | 2.25 | 2.31 | 2.34 | 2.39 | 0.019 | 0.021 | 0.022 | 0.025 |
| 123b | I-18 | 0.88 | P-2 | 2.22 | 2.28 | 2.30 | 2.35 | 0.017 | 0.019 | 0.021 | 0.021 |
| 123c | I-18 | 0.76 | P-2 | 2.21 | 2.27 | 2.29 | 2.33 | 0.016 | 0.018 | 0.019 | 0.021 |
| 123d | I-18 | 0.65 | P-2 | 2.18 | 2.23 | 2.29 | 2.30 | 0.014 | 0.016 | 0.017 | 0.019 |

Y-2 (Comparative coupler)

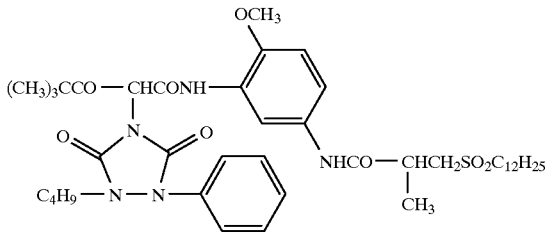

Y-3 (Comparative coupler)

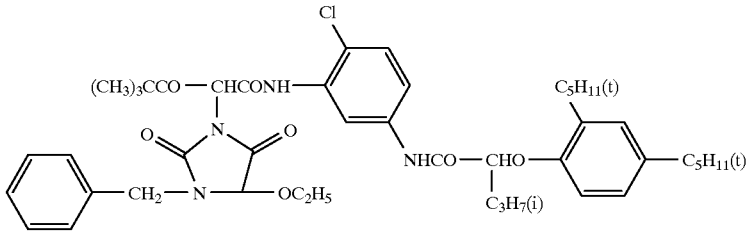

Y-4 (Comparative coupler)

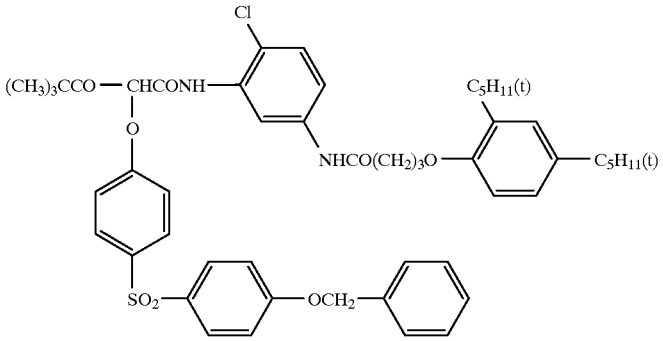

As is apparent from Table 4, if the yellow couplers out of the present invention are used, Dmax fluctuation in processing A through D is considerable. In addition, fogging is high at processing D wherein Dmax was high. In the case of a light-sensitive material for direct appreciation use, fogging is preferably 0.020 or less. If the fogging exceeds 0.025 or more, deterioration of image quality is apparently accompanied. In addition, if the amount of the yellow couplers out of the present invention is increased, fluctuation of processing A through D becomes reduced. However, it is not sufficient. On the contrary, deterioration of fogging becomes unfavorably big. In addition, even if the polymer compounds of the present invention are combined to the yellow couplers out of the present invention are combined, fluctuation of Dmax of processing A through D sparsely reduced. In addition, fogging in processing D cannot be reduced.

On the contrary, in the case of samples (119 through 128) wherein the yellow couplers (I-5 and I-15) of the present invention and the polymers (P-2) were added, Dmax fluctuation of processing's A through D becomes extremely small. Even in process A, it was found that sufficient coloring properties could be obtained. In addition, rise of fogging in processing A through D is also minimized to a satisfactory level. In addition, when the present invention is combined, sufficient coloring properties and low fogging performances could be obtained including fluctuation due to processing even if the coating amount was reduced.

It is evident from the results of the performance of Samples 122 and 124 through 127 that the combination effects of the present invention becomes more prominent by setting the amount of anti-stain agent (HQ-4) contained in the yellow coupler dispersed solution at 1–5 mol % against the yellow coupler.

Example 2

Samples 201 to 224 were prepared in the same way as the Sample 119, except that additives shown in Table 5 were added to the first layer. Amount of the additives are;

additive a: 0.2 mmol/$m^2$, additive b: 0.4 mmol/$m^2$, additive c: 0.03 mmol/$m^2$ (for samples 201–204, 206–211, 213–216) 0.015 mmol/$m^2$ (for samples 222) 0.05 mmol/$m^2$ (for samples 223) 0.07 Mmol/$m^2$ (for samples 224)

The same test as in Example 1 were carried out. The result is summarized in Table 5.

TABLE 5

| Sample No. | 1st layer Yellow Coupler (m mol/m²) | Additives a | b | c | $D_{max}$ Process A | Process B | Process C | Process D | Fog Process A | Process B | Process C | Process D |
|---|---|---|---|---|---|---|---|---|---|---|---|---|
| 201 | I-1 | — | — | HQ-9 | 2.13 | 2.19 | 2.24 | 2.28 | 0.015 | 0.016 | 0.017 | 0.019 |
| 202 | I-1 | — | B-15 | HQ-9 | 2.15 | 2.20 | 2.25 | 2.30 | 0.015 | 0.017 | 0.018 | 0.020 |
| 203 | I-1 | 2-20 | — | HQ-9 | 2.16 | 2.21 | 2.25 | 2.29 | 0.014 | 0.015 | 0.017 | 0.018 |
| 204 | I-1 | 2-20 | B-15 | HQ-9 | 2.17 | 2.24 | 2.27 | 2.31 | 0.014 | 0.015 | 0.017 | 0.019 |
| 205 | I-5 | — | — | — | 2.20 | 2.24 | 2.28 | 2.34 | 0.019 | 0.021 | 0.023 | 0.025 |
| 206 | I-5 | — | — | HQ-4 | 2.20 | 2.25 | 2.26 | 2.33 | 0.018 | 0.020 | 0.022 | 0.023 |
| 207 | I-5 | — | B-21 | HQ-4 | 2.24 | 2.31 | 2.33 | 2.36 | 0.019 | 0.021 | 0.022 | 0.024 |
| 208 | I-5 | ST-1 | — | HQ-4 | 2.15 | 2.21 | 2.24 | 2.29 | 0.019 | 0.020 | 0.021 | 0.022 |
| 209 | I-5 | 2-10 | — | HQ-4 | 2.18 | 2.24 | 2.26 | 2.29 | 0.018 | 0.019 | 0.019 | 0.021 |
| 210 | I-5 | 2-17 | — | HQ-4 | 2.21 | 2.27 | 2.28 | 2.31 | 0.017 | 0.018 | 0.019 | 0.020 |
| 211 | I-5 | 2-17 | B-21 | HQ-4 | 2.24 | 2.30 | 2.31 | 2.34 | 0.017 | 0.018 | 0.019 | 0.020 |
| 212 | I-15 | — | — | — | 2.19 | 2.26 | 2.30 | 2.33 | 0.019 | 0.020 | 0.022 | 0.024 |
| 213 | I-15 | — | — | HQ-4 | 2.20 | 2.27 | 2.29 | 2.32 | 0.016 | 0.019 | 0.020 | 0.021 |
| 214 | I-15 | — | B-15 | HQ-4 | 2.25 | 2.30 | 2.32 | 2.35 | 0.016 | 0.018 | 0.020 | 0.021 |
| 215 | I-15 | 2-17 | — | HQ-4 | 2.24 | 2.30 | 2.31 | 2.33 | 0.015 | 0.017 | 0.018 | 0.019 |
| 216 | I-15 | 2-17 | B-15 | HQ-4 | 2.28 | 2.33 | 2.34 | 2.36 | 0.015 | 0.017 | 0.018 | 0.019 |
| 217 | I-19 | — | — | — | 2.20 | 2.26 | 2.29 | 2.35 | 0.018 | 0.020 | 0.021 | 0.024 |
| 218 | I-19 | — | — | HQ-4 | 2.20 | 2.25 | 2.28 | 2.33 | 0.016 | 0.018 | 0.019 | 0.021 |
| 219 | I-19 | — | B-15 | HQ-4 | 2.23 | 2.29 | 2.32 | 2.35 | 0.016 | 0.018 | 0.019 | 0.021 |
| 220 | I-19 | 2-10 | — | HQ-4 | 2.21 | 2.27 | 2.30 | 2.32 | 0.015 | 0.016 | 0.017 | 0.019 |
| 221 | I-19 | 2-6 | B-15 | HQ-4 | 2.24 | 2.30 | 2.32 | 2.34 | 0.015 | 0.017 | 0.017 | 0.019 |
| 222 | I-5 | 2-17 | B-21 | HQ-4 | 2.29 | 2.33 | 2.34 | 2.37 | 0.016 | 0.017 | 0.018 | 0.020 |
| 223 | I-5 | 2-17 | B-21 | HQ-4 | 2.26 | 2.30 | 2.31 | 2.33 | 0.015 | 0.016 | 0.018 | 0.019 |
| 224 | I-5 | 2-17 | B-21 | HQ-4 | 2.22 | 2.27 | 2.28 | 2.30 | 0.015 | 0.016 | 0.017 | 0.019 |

Redox potential of additive "a". ST-1: 2060 mV, 1-10: 1520 mV, 2-6: 1580 mV, 2-17: 1590 mV, 2-20: 1560 mV.

Redox potential of additive "a". ST-1: 2060 mV, 1-10: 1520 mv, 2-6: 1580 mV, 2-17: 1590 mV, 2-20: 1560 mV.

Example 3

Samples 301 to 316 were prepared in the same way as the Samples 204, 211, 216 and 221 except that additives Z1 (Compound of Formula V) and Z2 (Compound of Formula IV) shown in Table 5 were further added to the first layer. Samples 301–304 were prepared based on the Sample 204, Samples 305–308 were prepared based on the Sample 211, Samples 309–312 were prepared based on the Sample 216, and Samples 313–316 were prepared based on the Sample 221. The amount of the additives were $1\times10^{-5}$ mol for Z1 (Compound of Formula V) and $2\times10^{-5}$ mol for Z2 (Compound of Formula IV).

The same test were carried out as in Example 1. The result is summarized in Table 6.

TABLE 6

| Sample No. | 1st layer Yellow Coupler (m mol/m²) | Additive Z1 | Z2 | $D_{max}$ Process A | Process B | Process C | Process D | Fog Process A | Process B | Process C | Process D |
|---|---|---|---|---|---|---|---|---|---|---|---|
| 301 | I-1 | — | — | 2.18 | 2.24 | 2.27 | 2.31 | 0.014 | 0.015 | 0.017 | 0.019 |
| 302 | I-1 | I-1 | — | 2.16 | 2.22 | 2.26 | 2.30 | 0.014 | 0.015 | 0.016 | 0.018 |
| 303 | I-1 | — | II-2 | 2.18 | 2.23 | 2.27 | 2.31 | 0.013 | 0.015 | 0.015 | 0.018 |
| 304 | I-1 | I-1 | II-2 | 2.18 | 2.23 | 2.27 | 2.31 | 0.013 | 0.014 | 0.015 | 0.017 |
| 305 | I-5 | — | — | 2.24 | 2.30 | 2.31 | 2.34 | 0.017 | 0.018 | 0.019 | 0.020 |
| 306 | I-5 | I-1 | — | 2.23 | 2.28 | 2.30 | 2.32 | 0.017 | 0.018 | 0.018 | 0.020 |
| 307 | I-5 | — | II-1 | 2.24 | 2.30 | 2.31 | 2.33 | 0.016 | 0.017 | 0.018 | 0.019 |
| 308 | I-5 | I-1 | II-1 | 2.24 | 2.29 | 2.31 | 2.34 | 0.015 | 0.016 | 0.017 | 0.018 |
| 309 | I-15 | — | — | 2.28 | 2.33 | 2.34 | 2.36 | 0.015 | 0.017 | 0.018 | 0.019 |
| 310 | I-15 | I-8 | — | 2.26 | 2.30 | 2.32 | 2.34 | 0.015 | 0.016 | 0.017 | 0.018 |
| 311 | I-15 | — | II-13 | 2.28 | 2.32 | 2.33 | 2.35 | 0.014 | 0.016 | 0.016 | 0.018 |
| 312 | I-15 | I-8 | II-13 | 2.28 | 2.32 | 2.33 | 2.36 | 0.014 | 0.015 | 0.016 | 0.017 |
| 313 | I-19 | — | — | 2.25 | 2.30 | 2.32 | 2.34 | 0.015 | 0.017 | 0.017 | 0.019 |
| 314 | I-19 | I-13 | — | 2.23 | 2.27 | 2.29 | 2.32 | 0.015 | 0.016 | 0.016 | 0.019 |
| 315 | I-19 | — | II-1 | 2.24 | 2.29 | 2.32 | 2.34 | 0.014 | 0.015 | 0.016 | 0.018 |
| 316 | I-19 | I-13 | II-1 | 2.24 | 2.29 | 2.32 | 2.33 | 0.014 | 0.015 | 0.015 | 0.017 |

Example 4

Samples 401 through 417 were prepared in the same manner as in Sample 211 except that the polymer P-2 was replaced polymers having number average molecular weight shown in Table 7. They were subjected to similar evaluation as in Example 1. The result is summarized in Table 7.

TABLE 7

| | 1st layer | | | | | | | | | | |
|---|---|---|---|---|---|---|---|---|---|---|---|
| | Yellow | | | $D_{max}$ | | | | Fog | | | |
| Sample | Coupler | Polymer | | Process | Process | Process | Process | Process | Process | Process | Process |
| No. | (m mol/m$^2$) | | MW | A | B | C | D | A | B | C | D |
| 401 | I-5 | P-1 | 10,000 | 2.23 | 2.28 | 2.31 | 2.34 | 0.018 | 0.018 | 0.019 | 0.021 |
| 402 | I-5 | P-1 | 23,000 | 2.22 | 2.28 | 2.31 | 2.33 | 0.018 | 0.019 | 0.019 | 0.020 |
| 403 | I-5 | P-1 | 190,000 | 2.16 | 2.21 | 2.24 | 2.29 | 0.017 | 0.018 | 0.018 | 0.020 |
| 404 | I-5 | P-2 | 6,500 | 2.25 | 2.30 | 2.32 | 2.35 | 0.017 | 0.018 | 0.019 | 0.020 |
| 405 | I-5 | P-2 | 12,000 | 2.24 | 2.30 | 2.31 | 2.34 | 0.017 | 0.018 | 0.019 | 0.020 |
| 406 | I-5 | P-2 | 38,000 | 2.23 | 2.28 | 2.30 | 2.34 | 0.017 | 0.018 | 0.018 | 0.020 |
| 407 | I-5 | P-2 | 150,000 | 2.20 | 2.25 | 2.28 | 2.32 | 0.016 | 0.017 | 0.018 | 0.020 |
| 408 | I-5 | P-2 | 220,000 | 2.15 | 2.21 | 2.29 | 2.29 | 0.016 | 0.017 | 0.017 | 0.019 |
| 409 | I-5 | P-10 | 8,000 | 2.28 | 2.31 | 2.34 | 2.38 | 0.019 | 0.021 | 0.022 | 0.025 |
| 410 | I-5 | P-10 | 45,000 | 2.26 | 2.29 | 2.33 | 2.36 | 0.019 | 0.021 | 0.021 | 0.024 |
| 411 | I-5 | P-10 | 260,000 | 2.16 | 2.23 | 2.27 | 2.29 | 0.018 | 0.020 | 0.021 | 0.023 |
| 412 | I-5 | P-14 | 17,000 | 2.20 | 2.24 | 2.28 | 2.31 | 0.016 | 0.018 | 0.019 | 0.020 |
| 413 | I-5 | P-14 | 140,000 | 2.17 | 2.21 | 2.24 | 2.29 | 0.016 | 0.018 | 0.018 | 0.020 |
| 414 | I-5 | P-14 | 340,000 | 2.12 | 2.18 | 2.20 | 2.25 | 0.016 | 0.017 | 0.018 | 0.019 |
| 415 | I-5 | P-60 | 13,000 | 2.26 | 2.30 | 2.32 | 2.37 | 0.019 | 0.021 | 0.022 | 0.025 |
| 416 | I-5 | P-60 | 60,000 | 2.24 | 2.27 | 2.31 | 2.35 | 0.019 | 0.022 | 0.021 | 0.023 |
| 417 | I-5 | P-60 | 210,000 | 2.16 | 2.22 | 2.26 | 2.29 | 0.018 | 0.020 | 0.021 | 0.023 |

Example 5

In place of polymer compound P-2 used for Sample 123 of Example 1, P-1, P-10, P-14 and P-60 were used to be subjected to a similar evaluation as in Example 1.

As a result, the same effects as in Example 1 of the present invention was obtained.

Example 6

In Example 2, NOS-868J produced by Konica was used as an automatic processing machine and ECOJET-P was used as a processing chemical. In accordance with CPK-2-J1, the samples were subjected to running processing. The resulting samples were evaluated in the same manner as in Example 2 so that it was confirmed that the effects of the present invention could be obtained.

A sample identical to Konica color QA paper type A6 was prepared except that yellow couplers and polymer compounds used for Sample 210 were used in the blue sensitive emulsion layer. This sample was subjected to processing and evaluation in the same manner as in Example 2. As a result, it was confirmed that the same effects as the present invention can be obtained.

Owing to the present invention, a silver halide photographic light-sensitive material which can maintain high coloring properties stably and also maintain high image quality properties having favorable gradation and which can sufficiently minimize increase of fogging caused by high activation of processing can be provided without increasing the amount of the yellow coupler even when the conditions of the developing solutions used changes variably in a processing steps in which rapid processing has been realized more than conventional type.

We claim:

1. A silver halide photographic light-sensitive material comprising a support and a silver halide emulsion layer containing a dispersion material which is obtained by emulsifying a mixture of a yellow coupler represented by Formula I and a polymer compound that is insoluble in water and soluble in an organic solvent, Formula I

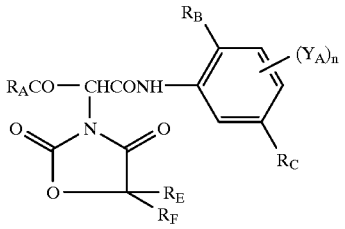

wherein $R_A$ represents an alkyl group; $R_B$ represents a halogen atom or an alkoxy group; $R_C$ represents —$COOR_{D1}$, —$COOR_{D2}COOR_{D1}$—, —$NHCOR_{D2}SO_2R_{D1}$, —$N(R_{D3})SO_2R_{D1}$, —$NHCOR_{D2}SO_2R_{D1}$, —$N(R_{D3})SO_2R_{D1}$ or —$SO_2N(R_{D3})R_{D1}$; $R_{D1}$ represents a monovalent organic group; $R_{D2}$ represents an alkylene group; $R_{D3}$ represents an alkyl group, an aralkyl group or a hydrogen atom; $Y_A$ represents a monovalent organic group; n represents 0 or 1; and $R_E$ and $R_F$ independently represent a hydrogen atom or an alkyl group.

2. The silver halide photographic light-sensitive material as claimed in claim 1, wherein the silver halide photographic light-sensitive material further comprises a compound represented by formula 1, Formula 1

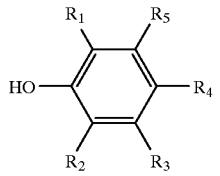

wherein $R_1$ is a tertiary alkyl group; $R_2$ is a primary or a secondary alkyl group; $R_3$, $R_4$ and $R_5$ are each an alkyl group, an alkoxycarbonyl group, a phenoxycarbonyl group, an alkoxy group, a phenoxy group or a phenylthio group, the groups represented by $R_1$, $R_3$, $R_4$ or $R_5$ each may have a substituent and the group represented by $R_2$ may has a substituent other than a phenyl group.

3. The silver halide photographic light-sensitive material as claimed in claim 1, wherein the silver halide photographic light-sensitive material comprises a hydroquinone derivative, gallic acid derivatives, 2,4-disulfonamide phenol derivatives and hydrazine derivatives in an amount of 1–5 mol % of the yellow coupler.

4. The silver halide photographic light-sensitive material as claimed in claim 1, wherein number average molecular weight of the polymer 200,000 or less.

5. The silver halide photographic light-sensitive material as claimed in claim 2, wherein the silver halide photographic light-sensitive material comprises a compound represented by Formula B, Formula B

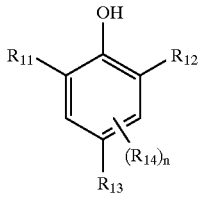

wherein $R_{11}$, $R_{12}$ and $R_{13}$ independently represent a hydrogen atom or a straight-chained or branch-chained unsubstituted alkyl group; $R_{14}$ represents an alkyl group or a halogen atom, provided that $R_{11}$, $R_{12}$ and $R_{13}$ are not concurrently hydrogen atoms; n represents 0, 1 or 2; and when n is 2, two $R_{14}$ may be the same or different.

6. The silver halide photographic light-sensitive material as claimed in claim 2, wherein the silver halide photographic light-sensitive material comprises a compound represented by Formula IV or V, Formula IV

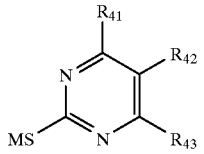

wherein M is a hydrogen atom, an alkali metal atom or a quartenary ammonium group; $R_1$, $R_2$ and $R_3$ are each independently a hydrogen atom, a halogen atom, an alkyl group, an alkenyl group, an alkoxyl group, an aryl group, a hydroxyl group, a mercapto group, a phosphono group, an amino group, a nitro group, a cyano group, an alkoxycarbonyl group, an aryloxycarbonyl group, a carbamoyl group or a sulfamoyl group; $R_{41}$ and $R_{42}$, or $R_{42}$ and $R_{43}$ are each may be bonded to form a ring;

Formula V

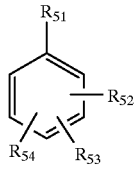

wherein $R_{51}$ and $R_{52}$, which may be the same or different, are each a —$OR_{55}$ or —$N(R_{56})R_{57}$ in which $R_{55}$ is a hydrogen atom, an alkyl group, an aryl group or a heterocyclic group; $R_{53}$, $R_{54}$, $R_{56}$ and $R_{57}$, which may be the same or different, are each a hydrogen atom, an alkyl group, an aryl group, a heterocyclic group, a sulfonyl group, a carbonyl group, a carbamoyl group or a group accelerating adsorption with silver halide; provided that at least one of $R_{53}$, $R_{54}$, $R_{55}$, $R_{56}$ and $R_{57}$ is a group accelerating adsorption with silver halide or a group having a group accelerating adsorption with silver halide as a substituent.

7. The silver halide photographic light-sensitive material as claimed in claim 2, wherein the silver halide photographic light-sensitive material comprises a compound represented by Formula 1 or Formula 2, Formula 1

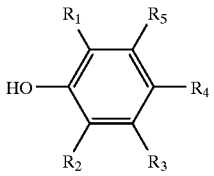

wherein $R_1$ is a tertiary alkyl group; $R_2$ is a primary or a secondary alkyl group; $R_3$, $R_4$ and $R_5$ are each an alkyl group, an alkoxycarbonyl group, a phenoxycarbonyl group, an alkoxy group, a phenoxy group or a phenylthio group, the groups represented by $R_1$, $R_3$, $R_4$ or $R_5$ each may have a substituent and the group represented by $R_2$ may has a substituent other than a phenyl group, Formula 2

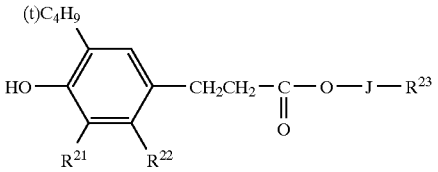

wherein $R^{21}$ and $R^{22}$ independently represent a hydrogen atom or an alkyl group having 1 to 5 carbon atoms; J represents an alkylene group or a simple bond; $R^{23}$ represents a heterocyclic residue.

8. The silver halide photographic light-sensitive material as claimed in claim 1, wherein an amount of the yellow coupler is $0.50\times10^{-3}$–$1.10\times10^{-3}$ mol/m$^2$.

9. The silver halide photographic light-sensitive material as claimed in claim 2, wherein the silver halide photographic light-sensitive material comprises a compound represented by Formula IV

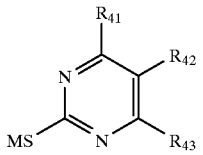

wherein M is a hydrogen atom, an alkali metal atom or a quartenary ammonium group; $R_1$, $R_2$ and $R_3$ are each independently a hydrogen atom, a halogen atom, an alkyl group, an alkenyl group, an alkoxyl group, an aryl group, a hydroxyl group, a mercapto group, a phosphono group, an amino group, a nitro group, a cyano group, an alkoxycarbonyl group, an aryloxycarbonyl group, a carbamoyl group or a sulfamoyl group; $R_{41}$ and $R_{42}$, or $R_{42}$ and $R_{43}$ are each may be bonded to form a ring.

10. The silver halide photographic light-sensitive material as claimed in claim 2, wherein the silver halide photographic light-sensitive material comprises a compound represented by Formula V

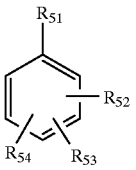

wherein $R_{51}$ and $R_{52}$, which may be the same or different, are each a —$OR_{55}$ or —$N(R_{56})R_{57}$ in which $R_{55}$ is a hydrogen atom, an alkyl group, an aryl group or a heterocyclic group; $R_{53}$, $R_{54}$, $R_{56}$ and $R_{57}$, which may be the same or different, are each a hydrogen atom, an alkyl group, an aryl group, a heterocyclic group, a sulfonyl group, a carbonyl group, a carbamoyl group or a group accelerating adsorption with silver halide; provided that at least one of $R_{53}$, $R_{54}$, $R_{55}$, $R_{56}$ and $R_{57}$ is a group accelerating adsorption with silver halide or a group having a group accelerating adsorption with silver halide as a substituent.

11. The silver halide photographic light-sensitive material as claimed in claim 1 wherein the silver amount/coupler amount in the silver halide emulsion contained in the identical layer is 2.2–3.7 in mol ratio.

12. The silver halide photographic light-sensitive material as claimed in claim 1 wherein generation ratio of developed silver in the maximum blue density region is 85–99%.

* * * * *